US011780629B2

(12) United States Patent
Sill et al.

(10) Patent No.: US 11,780,629 B2
(45) Date of Patent: Oct. 10, 2023

(54) BAG RACK AND METHOD OF USING SAME

(71) Applicant: Inno-Pak, LLC, Delaware, OH (US)

(72) Inventors: Jonathan D. Sill, Delaware, OH (US); Christopher T. Sill, Westerville, OH (US)

(73) Assignee: Inno-Pak, LLC, Delaware, OH (US)

( * ) Notice: Subject to any disclaimer, the term of this patent is extended or adjusted under 35 U.S.C. 154(b) by 142 days.

(21) Appl. No.: 17/125,948

(22) Filed: Dec. 17, 2020

(65) Prior Publication Data

US 2021/0179308 A1 Jun. 17, 2021

Related U.S. Application Data

(60) Provisional application No. 62/949,003, filed on Dec. 17, 2019.

(51) Int. Cl.

| | |
|---|---|
| ***B65B 67/12*** | (2006.01) |
| ***B65D 33/00*** | (2006.01) |
| ***B65D 33/08*** | (2006.01) |
| ***B65B 67/02*** | (2006.01) |
| ***B65D 33/25*** | (2006.01) |

(52) U.S. Cl.

CPC ..... *B65B 67/1227* (2013.01); *B65B 67/02* (2013.01); *B65D 33/001* (2013.01); *B65D 33/08* (2013.01); *B65D 33/2508* (2013.01); *B65B 2067/1294* (2013.01)

(58) Field of Classification Search

None

See application file for complete search history.

(56) References Cited

U.S. PATENT DOCUMENTS

| | | | |
|---|---|---|---|
| 2,682,956 | A | 7/1954 | Pike |
| 2,891,676 | A | 6/1959 | Miller |
| 3,055,508 | A | 9/1962 | Reeser |
| 3,180,557 | A | 4/1965 | Thulin |

(Continued)

FOREIGN PATENT DOCUMENTS

| | | |
|---|---|---|
| CA | 115592 | 9/2007 |
| DE | 1844267 U | 12/1961 |
| GB | 2100248 | 3/2001 |

OTHER PUBLICATIONS

Baggaroo Plastic Grocery Bag Holder Support Frame https://a.co/d9Z7oQKM, Amazon customer review date Sep. 10, 2017 (Year: 2017).

(Continued)

*Primary Examiner* — Tanzim Imam

(74) *Attorney, Agent, or Firm* — Ward and Smith, P.A.; Ryan K. Simmons

(57) ABSTRACT

A bag rack and method of using the same is disclosed. The presently disclosed bag rack may include a bag rack that is formed of a base assembly and a hanger assembly on which multiple storage bags may be hung. A method of using the presently disclosed bag rack may include, but is not limited to, the steps of hanging the storage bags on the bag rack, opening the frontmost storage bag, holding open or propping open the storage bag using a bag hooking mechanism, placing the food item(s) or any other types of item(s) into the storage bag, removing the bag hooking mechanism, if used, closing the storage bag, and removing the filled storage bag from the bag rack.

17 Claims, 28 Drawing Sheets

(56) References Cited

U.S. PATENT DOCUMENTS 3,200,959 A 8/1965 Theim
3,334,766 A 8/1967 Rogus
3,514,015 A 5/1970 Hein
3,759,505 A 9/1973 Callanan
3,806,146 A 4/1974 Shaw
4,031,689 A 6/1977 Sullivan
4,199,122 A 4/1980 Christie
4,241,561 A 12/1980 Suominen
D264,651 S 6/1982 Adamson
D273,159 S 3/1984 Adamson et al.
4,458,867 A 7/1984 Malik
4,487,388 A 12/1984 Provan
4,623,111 A 11/1986 Prader
4,723,743 A 2/1988 Jenkins
4,730,799 A 3/1988 Foss et al.
4,750,694 A 6/1988 Bateman
4,821,985 A 4/1989 DeMatteis et al.
4,830,317 A * 5/1989 Kober ..... B65B 67/1244 221/36
4,840,336 A * 6/1989 Stroh ..... B65B 67/1227 D34/5
4,846,586 A 7/1989 Bruno
4,915,248 A 4/1990 Chap
4,921,194 A * 5/1990 Libby ..... B65B 67/1227 248/306
4,926,748 A 5/1990 Smith et al.
5,014,944 A 5/1991 Malik et al.
5,018,691 A 5/1991 King
D319,124 S 8/1991 Harjung
D319,125 S 8/1991 Currie
D324,748 S 3/1992 Bagamery
5,100,000 A 3/1992 Huseman
5,169,101 A 12/1992 Wenzel et al.
D332,333 S 1/1993 Wenzel et al.
5,213,145 A * 5/1993 Huang ..... A47F 13/085 141/390
D362,577 S 9/1995 Green
5,465,846 A 11/1995 Blyth et al.
5,469,969 A * 11/1995 Huang ..... A47F 13/085 206/554
D372,826 S 8/1996 Hecker
5,682,730 A 11/1997 Dobreski
5,695,064 A * 12/1997 Huang ..... B65B 43/14 206/554
5,788,080 A 8/1998 Sill et al.
D421,170 S 2/2000 Siu
6,042,063 A * 3/2000 Kerr ..... B65B 67/1227 248/97
D428,544 S 7/2000 Moffitt et al.
6,454,223 B1 * 9/2002 Rosky ..... B65B 67/1227 248/100
6,536,951 B1 3/2003 Sill
7,066,389 B2 6/2006 Dickover et al.
7,175,139 B2 2/2007 Breeders
D552,901 S 10/2007 Wilfong, Jr. et al.
D553,320 S 10/2007 Rosen
D571,518 S 6/2008 Waldman
7,611,019 B2 11/2009 Alvarado
7,926,669 B2 4/2011 Alvarado
D699,966 S 2/2014 Sill et al.
9,415,886 B2 8/2016 Sill et al.
9,511,889 B2 12/2016 Sill et al.
RE47,317 E 3/2019 Sill et al.
2005/0105832 A1 5/2005 Trinko et al.
2006/0175475 A1 8/2006 Desantis
2006/0204148 A1 9/2006 Kohn
2007/0176058 A1 8/2007 Kohn et al.
2007/0186515 A1 * 8/2007 Ruetten ..... G07G 1/0036 211/85.15
2009/0261050 A1 10/2009 Curren
2010/0067831 A1 3/2010 Alvarado et al.
2011/0108499 A1 * 5/2011 So ..... B65B 67/1227 211/49.1
2011/0180496 A1 7/2011 Hernberg et al.
2012/0080565 A1 4/2012 Gallup
2012/0125970 A1 5/2012 Tsui
2013/0223766 A1 8/2013 Gebhardt
2013/0330163 A1 12/2013 Marsh
2014/0263121 A1 9/2014 Metcalfe et al.
2014/0318085 A1 * 10/2014 Sill ..... B65B 67/1266 211/49.1
2015/0048039 A1 2/2015 Laitila et al.
2015/0128535 A1 5/2015 McInnis

OTHER PUBLICATIONS

Plastic Grocery Bag Holder—Fits 11-1/2 "W x 6"D x 21"H Bag—Unit Measures 12"W x 12"L x 16"H—Chrome Checkout Shopping Bag Stand with PVC Plastic Base https://a.co/d/8WMt8gm, Feb. 9, 2013 (Year: 2013).

* cited by examiner (FRONT VIEW)

(SIDE VIEW)

(TOP VIEW)

(SIDE VIEW)

(FRONT VIEW)

FIG. 9 (TOP VIEW)

(SIDE VIEW)

(SIDE VIEW)

(SIDE VIEW)

(SIDE VIEW)

(SIDE VIEW)

BAG RACK AND METHOD OF USING SAME

CROSS-REFERENCE TO RELATED APPLICATIONS

This application claims priority to U.S. Patent Application 62/949,003 filed Dec. 17, 2019, the contents of which are hereby incorporated by reference in its entirety.

TECHNICAL FIELD

The present invention relates generally to packaging and more particularly to a bag rack and method of using the same.

BACKGROUND

In, for example, a grocery or food deli application in which food is preprocessed, precooked, or otherwise prepared for sale, there may be certain inefficiencies in packaging the prepared food items. For example, for a somewhat large food item, such as a precooked rotisserie chicken, it may be difficult for one person to hold open a storage bag and at the same time load the food item into the bag. Consequently, it may require two people to package the food item; for example, one person to hold open the storage bag while another person places the food item in the bag. Therefore, more efficient approaches are needed with respect to packaging food items that are preprocessed, precooked, or otherwise prepared for sale.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Further, the claimed subject matter is not limited to implementations that solve any or all disadvantages noted in any part of this disclosure.

According to at least one embodiment of the disclosed subject matter, a bag rack and dispensing system is provided. The system may include: a base assembly comprising side bars and crossbars coupled to the side bars, wherein at least one of the crossbars is located at a front portion of the base assembly; a hanger assembly, configured to support a plurality of storage bags in a removable manner thereon, mounted to the base assembly and comprising: a first portion coupled to one or more of the crossbars and positioned substantially horizontal, a second portion extending from the first portion in a substantially vertical direction, a third portion extending from the second portion in a substantially horizontal direction distally from the first portion, and a fourth portion extending from the third portion in a generally vertical direction distally from the first portion; a hooking assembly, configured to assist in holding open at least one of the plurality of storage bags, mounted to the base assembly and comprising at least one hooking bar extending substantially vertically to define a hook end extending towards the base assembly.

According at least to another embodiment of the disclosed subject matter, the hooking assembly includes: two continuous and opposing hooking bars; and a hooking crossbar extending between the ends of the opposing hooking bars.

According at least to another embodiment of the disclosed subject matter, the hooking assembly comprises a continuous hooking bar.

According at least to another embodiment of the disclosed subject matter, the hooking bar further defines a second hook end for mounting to the base assembly.

According at least to another embodiment of the disclosed subject matter, the side bars and crossbars are arranged to form a substantially boxed-shaped structure.

According at least to another embodiment of the disclosed subject matter, the side bars are arranged substantially parallel with one another and the crossbars are arranged substantially parallel with one another and wherein the side bars are arranged substantially perpendicular with the crossbars.

According at least to another embodiment of the disclosed subject matter, the base assembly comprises two side bars and three crossbars, wherein the three crossbars span a distance spaced between the two side bars.

According at least to another embodiment of the disclosed subject matter, the hanger assembly is mounted, and affixed to, one or more of the crossbars.

According at least to another embodiment of the disclosed subject matter, the hanger assembly comprises hanger bars and one or more hanger crossbars.

According at least to another embodiment of the disclosed subject matter, the hanger bars are arranged substantially parallel with one another.

According at least to another embodiment of the disclosed subject matter, at least two crossbars extend between the hanger bars within the second portion, and one of the at least two crossbars is in contact with the third portion.

According at least to another embodiment of the disclosed subject matter, at least one crossbar extends between the hanger bars at an endpoint of the hanger bars within the fourth portion.

According at least to another embodiment of the disclosed subject matter, the hanger assembly comprises a continuous hanger plate.

According at least to another embodiment of the disclosed subject matter, further comprising the plurality of storage bags, each comprising: a top portion and a detachable bottom portion, wherein the top portion comprises an engagement mechanism for engaging with the hanger assembly, and wherein the detachable bottom portion comprises a storage pouch and a resealable opening providing access to the storage pouch.

According at least to another embodiment of the disclosed subject matter, the engagement mechanism for engaging with the hanger assembly comprises holes for engaging hanger bars of the hanger assembly.

According at least to another embodiment of the disclosed subject matter, the bottom portion is detachable from the top portion by a perforation spanning a bottom edge of the top portion.

According at least to another embodiment of the disclosed subject matter, each of the plurality of storage bags further comprises a handle.

According at least to another embodiment of the disclosed subject matter, the plurality of storage bags are bound together at the top portion.

According at least to another embodiment of the disclosed subject matter, the plurality of storage bags are configured to store food items.

According at least to another embodiment of the disclosed subject matter, a method of packaging and dispensing items is provided. The method includes: hanging a plurality of storage bags on a rack, the rack comprising a base assembly and a hanger assembly, opening a frontmost storage bag of the plurality of storage bags via a resealable opening, holding open a front edge of the resealable opening of the frontmost storage bag, placing an item to be stored into the opened frontmost storage bag, resealing the resealable opening of the frontmost storage bag with the item placed therein, and removing the frontmost storage back from the plurality of storage bags and the rack.

BRIEF DESCRIPTION OF THE DRAWINGS

The foregoing, as well as the following Detailed Description of preferred embodiments, is better understood when read in conjunction with the appended drawings. For the purposes of illustration, there is shown in the drawings exemplary embodiments; however, the presently disclosed subject matter is not limited to the specific methods and instrumentalities disclosed.

DETAILED DESCRIPTION

Figure 1:
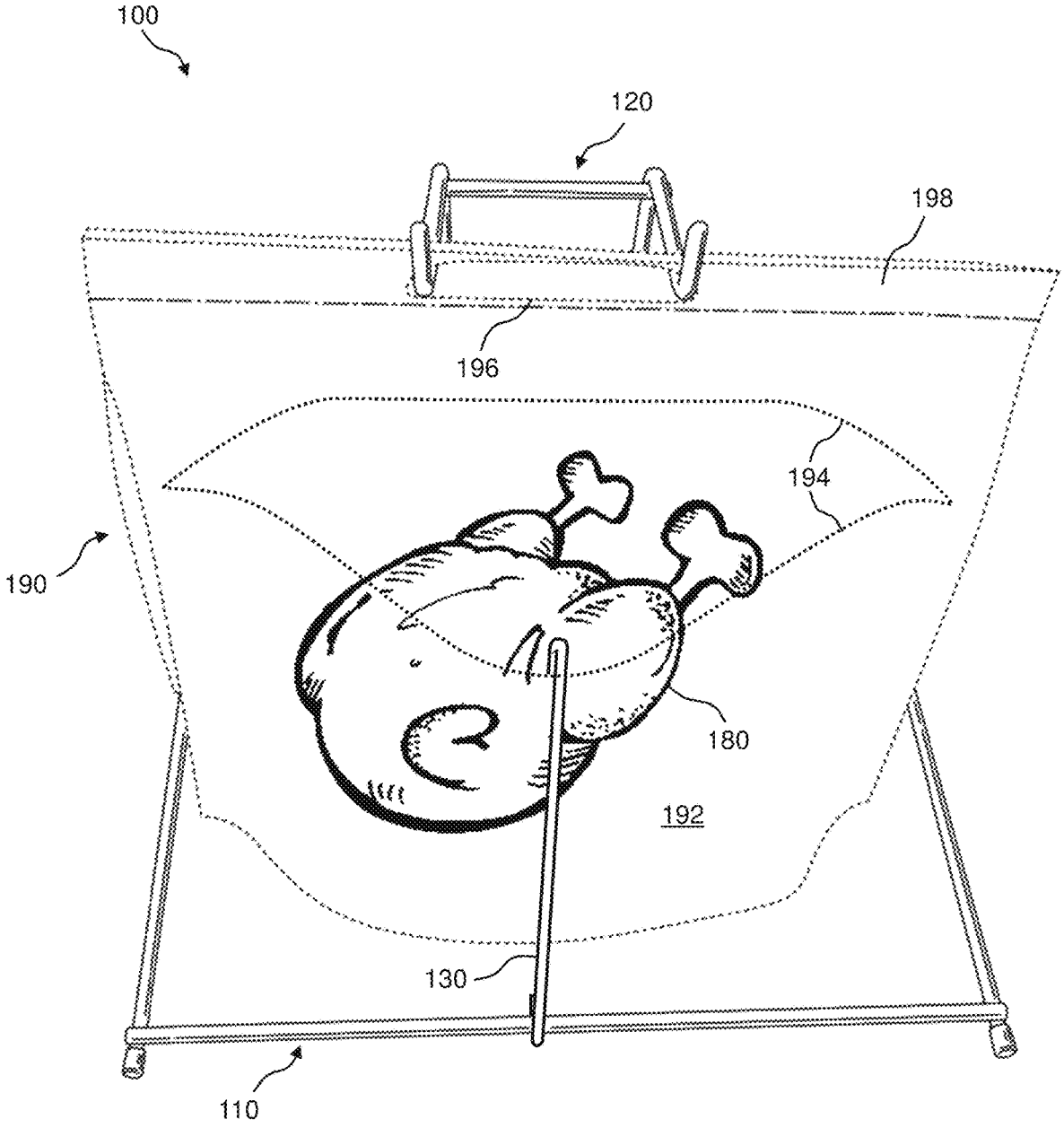
FIG. 1, FIG. 2, FIG. 3, FIG. 4, and FIG. 5 illustrate a front perspective view, a rear perspective view, a front view, a side view, and a top view, respectively, of an example of the presently disclosed bag rack holding one or more storage bags.
Figure 2:
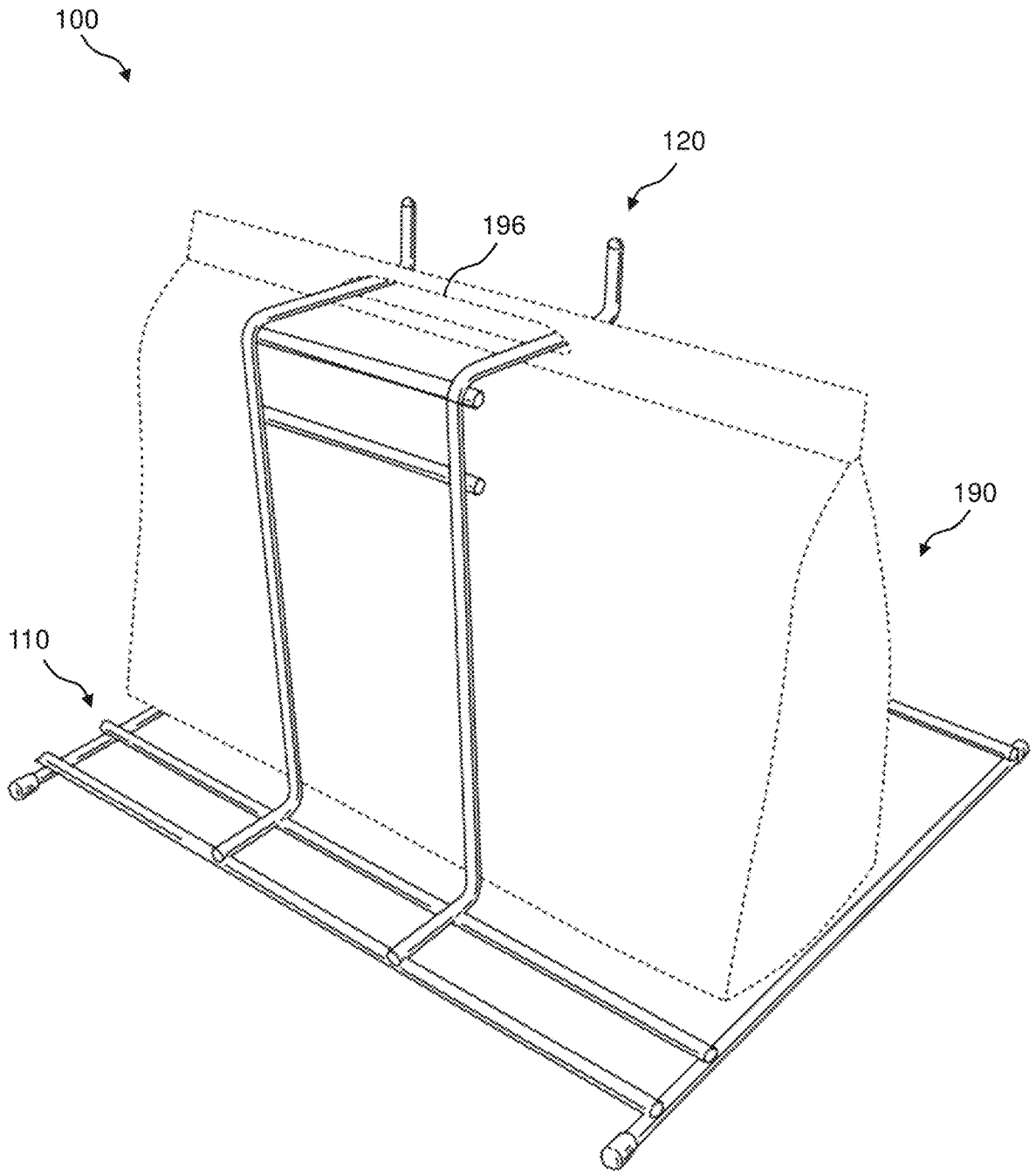
Figure 3:
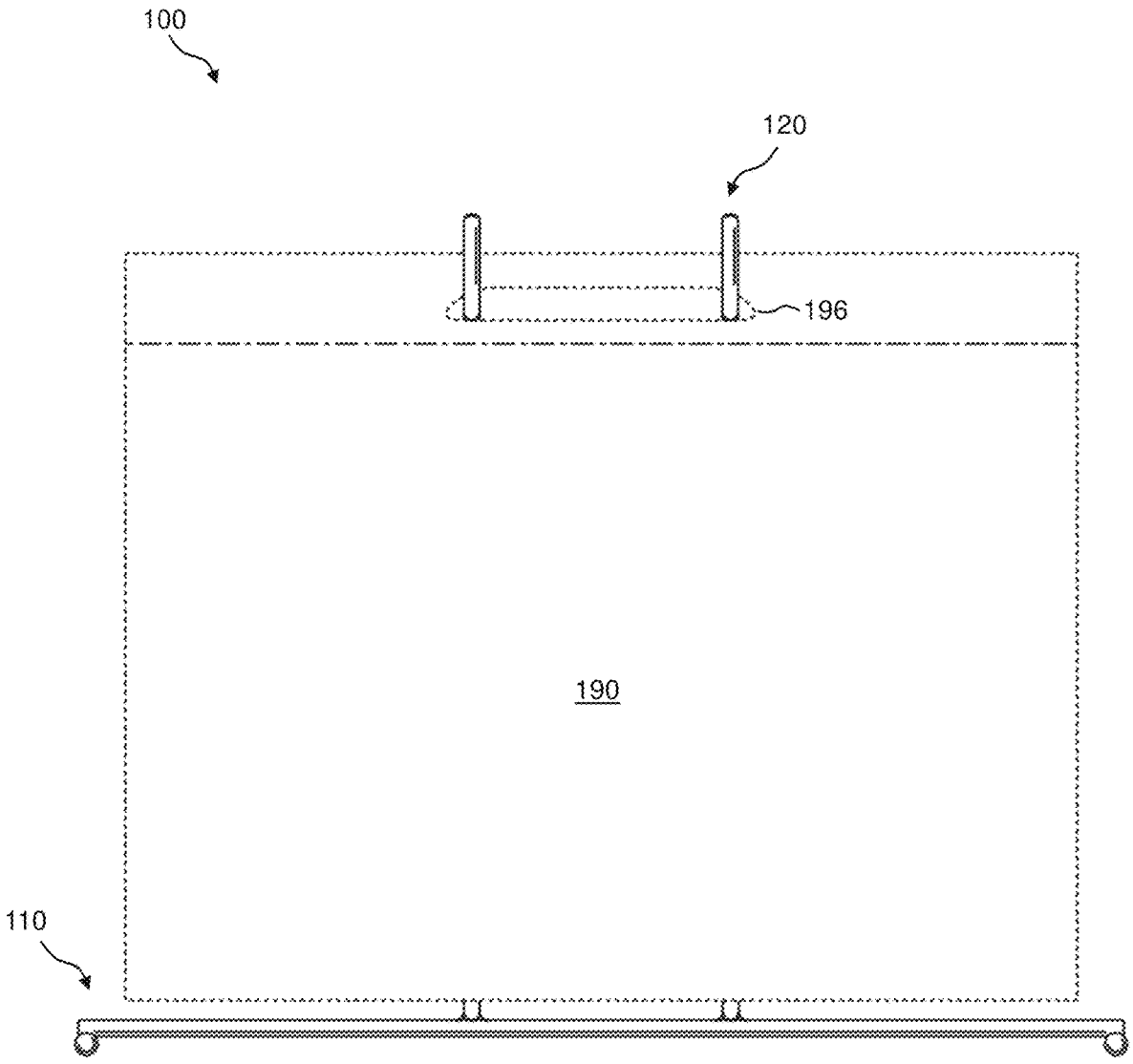
Figure 4:
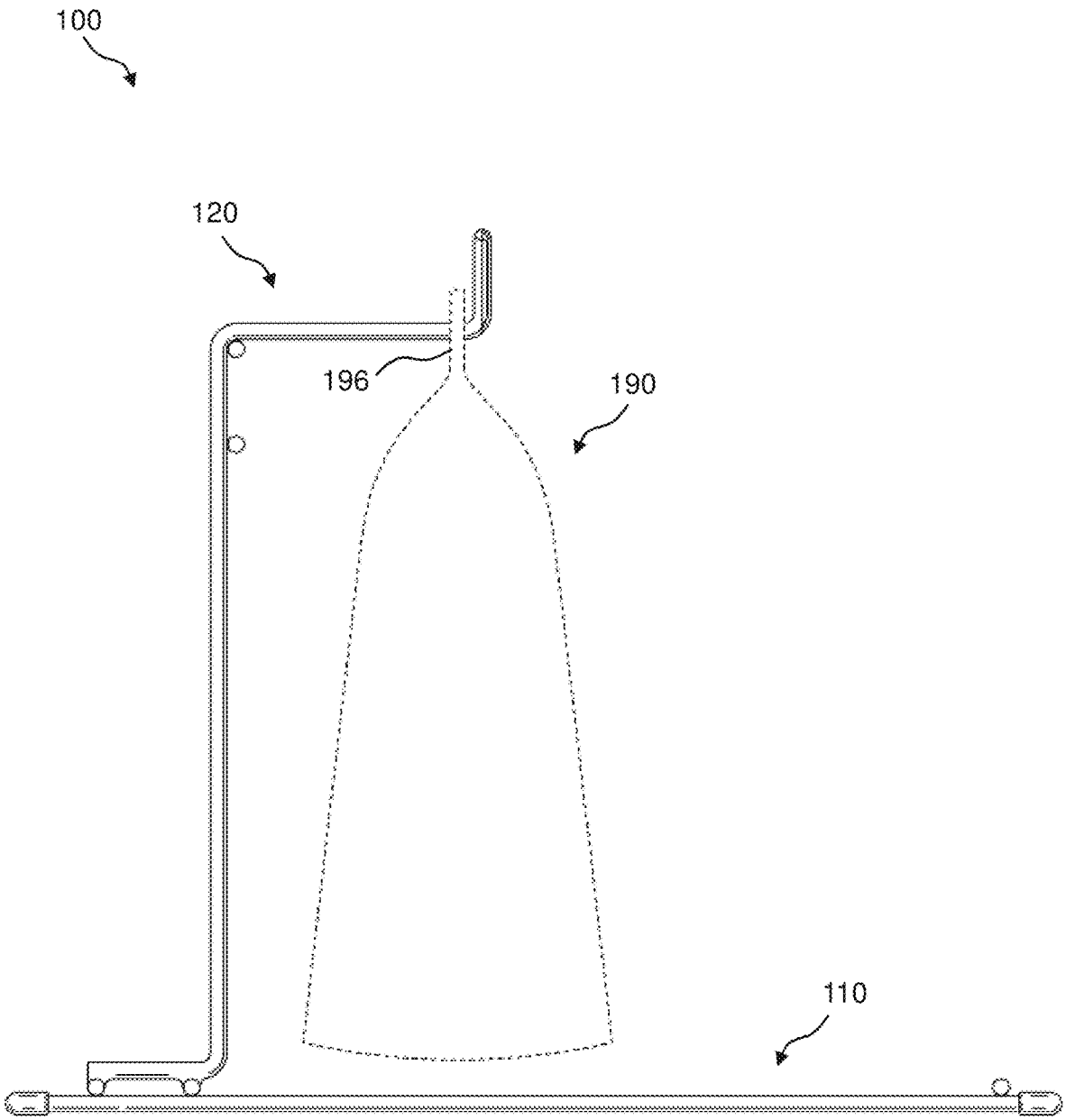
Figure 5:
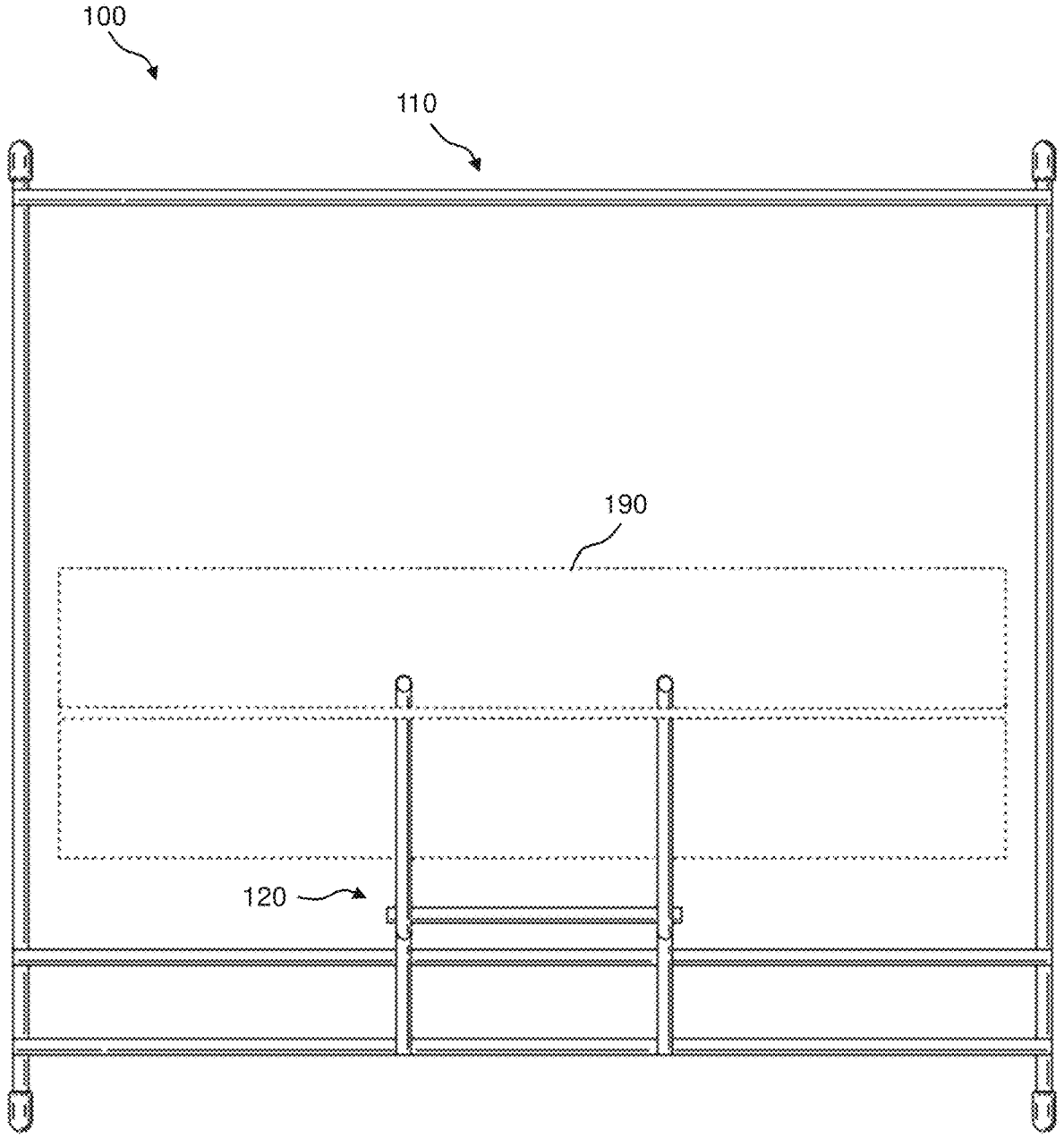

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a bag rack and method of using the same for packaging and dispensing items, such as food. The bag rack may include a hanger assembly mounted atop a base assembly for holding multiple storage bags in preparation for packaging items, such as food, therein. Additionally, the presently disclosed bag rack bag may include a bag hooking mechanism for holding open the storage bag. For example, when using the presently disclosed bag rack, the frontmost storage bag may be held open in a manner that is convenient of packing food items therein. Once packed, the frontmost storage bag may be sealed and then easily removed from the rack, exposing the next storage bag to be packed. Further, the presently disclosed bag rack allows the storage bag to be easily packed by one person, whereas conventional methods may require one person to hold open the storage bag while a second person places the food items in the bag.

While the presently disclosed bag rack and method are described hereinbelow in the context of packaging food items, the bag rack and method is not limited to packaging food items only. The presently disclosed bag rack and method may be used for packaging any type of item.

Referring now to FIG. 1, FIG. 2, FIG. 3, FIG. 4, and FIG. 5 is a front perspective view, a rear perspective view, a front view, a side view, and a top view, respectively, of a bag rack 100 for packaging and dispensing food items. In this example, bag rack 100 may be formed of a base assembly 110 and a hanger assembly 120. For example, hanger assembly 120 may be mounted atop base assembly 110. More details of bag rack 100 are described hereinbelow with reference to FIG. 6 through FIG. 10. Bag rack 100 may be designed to hold multiple storage bags. For example, multiple storage bags 190 may be hung on hanger assembly 120 of bag rack 100 in preparation for packaging food items therein.

Storage bags 190 may, for example, be plastic resealable storage bags. Each of the storage bags 190 may include a storage pouch 192 for holding, for example, food items. A resealable opening 194 in each of the storage bags 190 may provide access to storage pouch 192. In one example, resealable opening 194 may be a Ziploc® type of resealable opening. Further, each of the storage bags 190 may include a carry handle cutout 196 in an upper portion 198 of storage bag 190. Upper portion 198 may be above resealable opening 194. Carry handle cutout 196 may be, for example, an elongated opening along the top portion of the storage bag 190 that may be engaged with hanger assembly 120 of bag rack 100. In one example, carry handle cutout 196 may be about 3.25 inches long and about 0.5 inches wide (or high). However, it is contemplated that dimensions of carry handle cutout 196 may vary depending on the type and/or size storage bag 190. By way of example, FIG. 1 shows a food item 180 (e.g., a rotisserie chicken) inside storage pouch 192 of the frontmost storage bag 190 that is hanging on hanger assembly 120 of bag rack 100. Once the filled storage bag 190 is removed from bag rack 100, carry handle cutout 196 may be used for carrying the filled storage bag 190.

Figure 11:
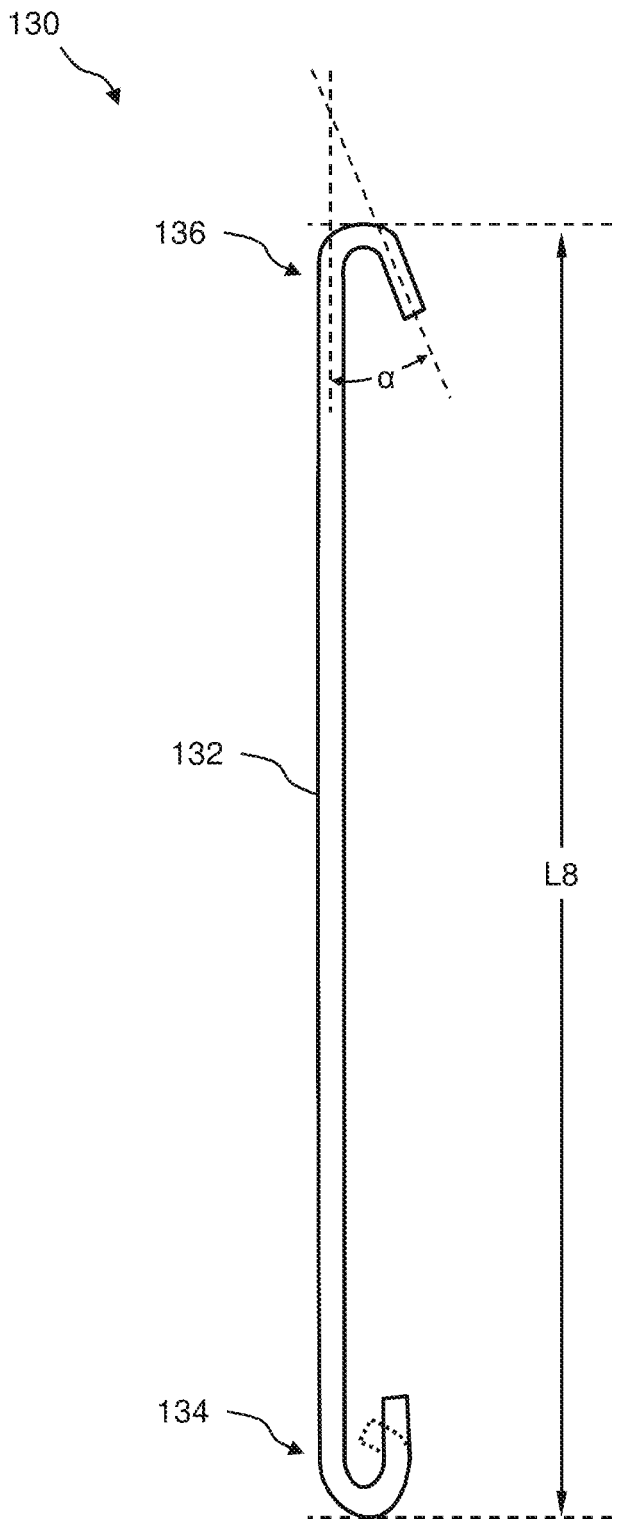
FIG. 11 illustrates a side view of a hooking device of the presently disclosed bag rack.

In one example, bag rack 100 may include a hooking assembly being, in one example a hooking device 130 (see FIG. 11), or in another example a hooking bracket 140 (see FIGS. 13 and 14) for assisting in holding the frontmost storage bag 190 open in a manner that is convenient for packing food items therein. In the example of FIG. 11, one end of hooking device 130 may be engaged with base assembly 110 of bag rack 100 while the opposite end may be engaged with the front edge of the open resealable opening 194 of storage bag 190. Hooking device 130 may be fitted loosely to and may be moveable along base assembly 110 of bag rack 100. More details of hooking device 130 are described hereinbelow with reference to FIG. 11. Once packed, hooking device 130 may be removed from the frontmost storage bag 190. Then, the frontmost storage bag 190 is sealed and easily removed from hanger assembly 120 of bag rack 100, exposing the next storage bag 190 to be packed. Base assembly 110 of bag rack 100 may be designed to safely balance storage bags 190 during the packaging process.

In other examples, bag rack 100 may include other bag hooking mechanisms, such as a hooking bracket that is shown and described hereinbelow with reference to FIG. 13, FIG. 14, and FIG. 15. In yet other examples, bag rack 100 may be absent any bag hooking mechanisms.

The physical size of bag rack 100 may be scaled to handle storage bags 190 of any capacity (by volume or weight). In one example, bag rack 100 may be sized to handle 2-quart capacity storage bags 190. In another example, bag rack 100 may be sized to handle 1-gallon capacity storage bags 190, and so on. Additionally, the size of hooking device 130, hooking bracket 180, and/or hooking plate 185 may be scaled accordingly.

Figure 6:
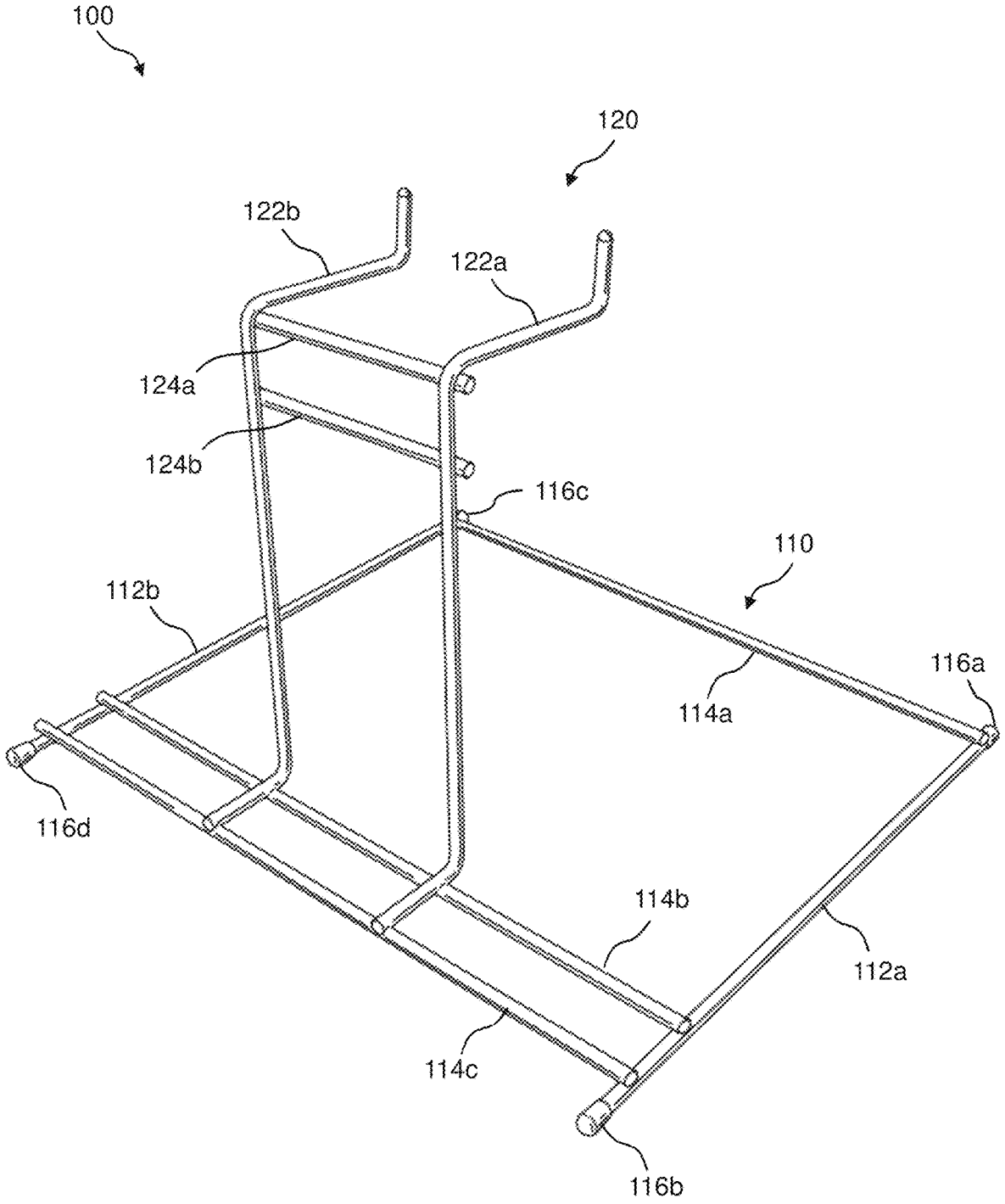
FIG. 6, FIG. 7, FIG. 8, and FIG. 9 illustrate a rear perspective view, a side view, a front view, and a top down view, respectively, of the presently disclosed bag rack.
Figure 7:
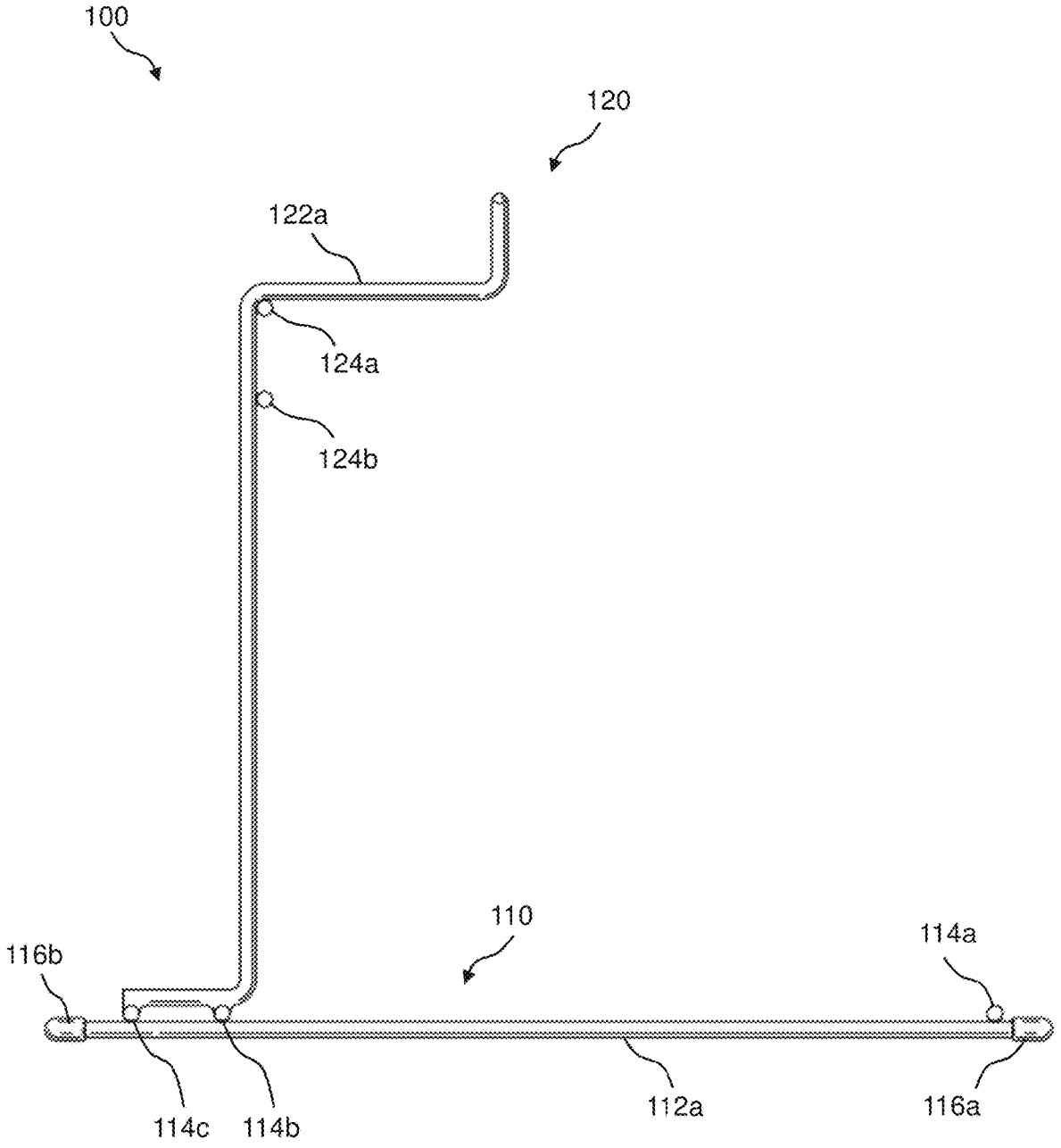
Figure 8:
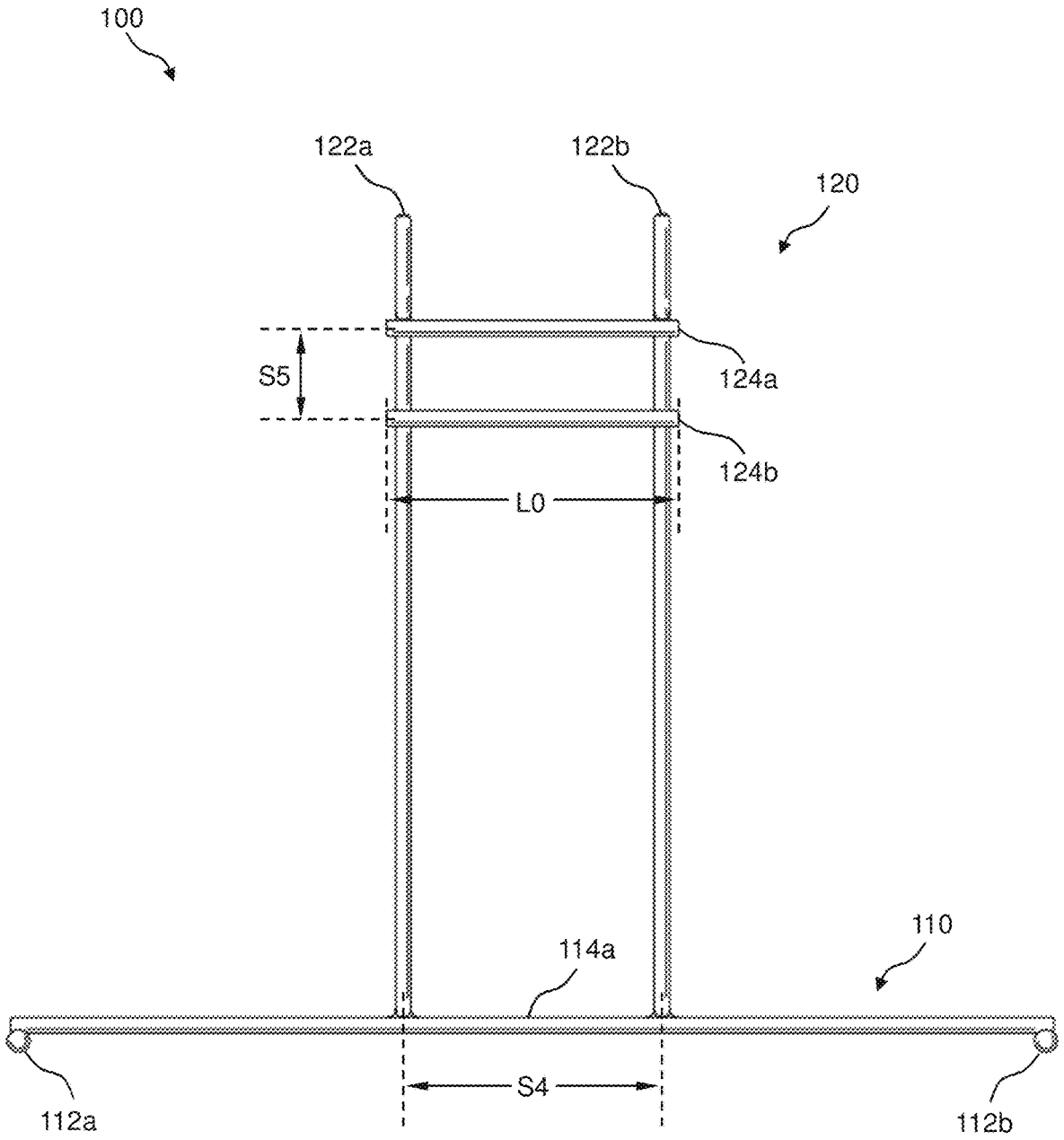
Figure 9:
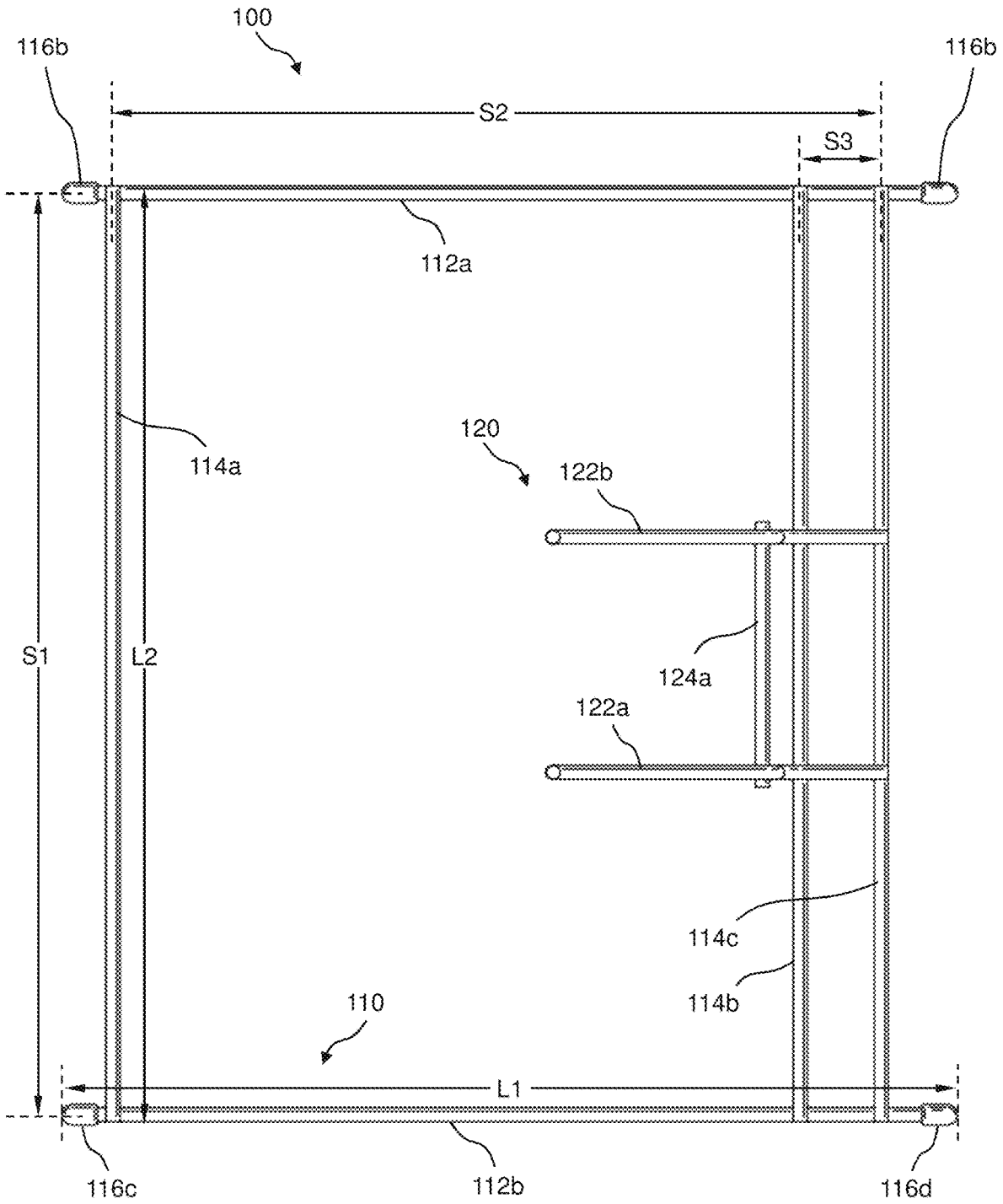

FIG. 6 through FIG. 9 show more details of bag rack 100 shown in FIG. 1 through FIG. 5. For example, FIG. 6 shows a rear perspective view of bag rack 100, FIG. 7 shows a side view of bag rack 100, FIG. 8 shows a front view of bag rack 100, and FIG. 9 shows a top down view of bag rack 100.

Referring to FIG. 6 through FIG. 9, base assembly 110 of bag rack 100 may include a pair of side bars 112 and multiple crossbars 114. For example, base assembly 110 may include a side bar 112*a* and a side bar 112*b*, which are arranged substantially parallel to each other. Spanning side bars 112*a* and 112*b* may be, for example, three crossbars 114 (e.g., crossbars 114*a*, 114*b*, and 114*c*), as shown. In particular, the combination of side bars 112*a* and 112*b* and crossbars 114*a* and 114*c* form a substantially boxed-shaped base assembly 110. Crossbar 114*b* may be provided in combination with crossbar 114*c* for support of hanger assembly 120. For example, hanger assembly 120 may be affixed to crossbars 114*b* and 114*c*, as shown. Referring to FIG. 9, side bars 112*a* and 112*b* may have an on-center spacing S1, crossbars 114*a* and 114*c* mat have an on-center spacing S2, and crossbars 114*b* and 114*c* may have an on-center spacing S2. Additionally, side bars 112 have a length L1 and crossbars 114 have a length L2.

Further, a set of plastic or rubber caps 116 may be installed on the ends of side bars 112. For example, caps 116*a* and 116*b* may be installed on the ends of side bar 112*a*. Caps 116*c* and 116*d* may be installed on the ends of side bar 112*b*. The caps 116 may be provided for aesthetic purposes, as well as to protect the user from any roughness at the ends of side bars 112.

Hanger assembly 120 of bag rack 100 may be arranged substantially orthogonal with respect to base assembly 110 of bag rack 100, as shown. Referring again to FIG. 6 through FIG. 9, hanger assembly 120 of bag rack 100 may include a pair of hanger bars 122 and one or more hanger crossbars 124. For example, hanger assembly 120 may include a hanger bar 122*a* and a hanger bar 122*b*, which may be arranged substantially parallel to each other. Spanning hanger bars 122*a* and 122*b* may, for example, be two hanger crossbars 124 (e.g., hanger crossbars 124*a* and 124*b*), as shown. Referring to FIG. 8, hanger bars 122*a* and 122*b* may have an on-center spacing S4 and hanger crossbars 124*a* and 124*c* may have an on-center spacing S5. Additionally, hanger crossbars 124 have a length L0. In one example, the length L0 may be about ¼ inches greater than the spacing S4.

Side bars 112 and crossbars 114 of base assembly 110, as well as hanger bars 122 and hanger crossbars 124 of hanger assembly 120 may be, for example, rigid rods that can be formed of any material that is suitably strong to support storage bags 190 and any content thereof. The cross-sectional diameters of the rods may vary depending on the material. In one example, side bars 112 and crossbars 114 of base assembly 110 and hanger bars 122 and hanger crossbars 124 of hanger assembly 120 may be metal rods, such as stainless steel or aluminum rods. In another example, side bars 112 and crossbars 114 of base assembly 110 and hanger bars 122 and hanger crossbars 124 of hanger assembly 120 may be plastic rods.

Figure 10:
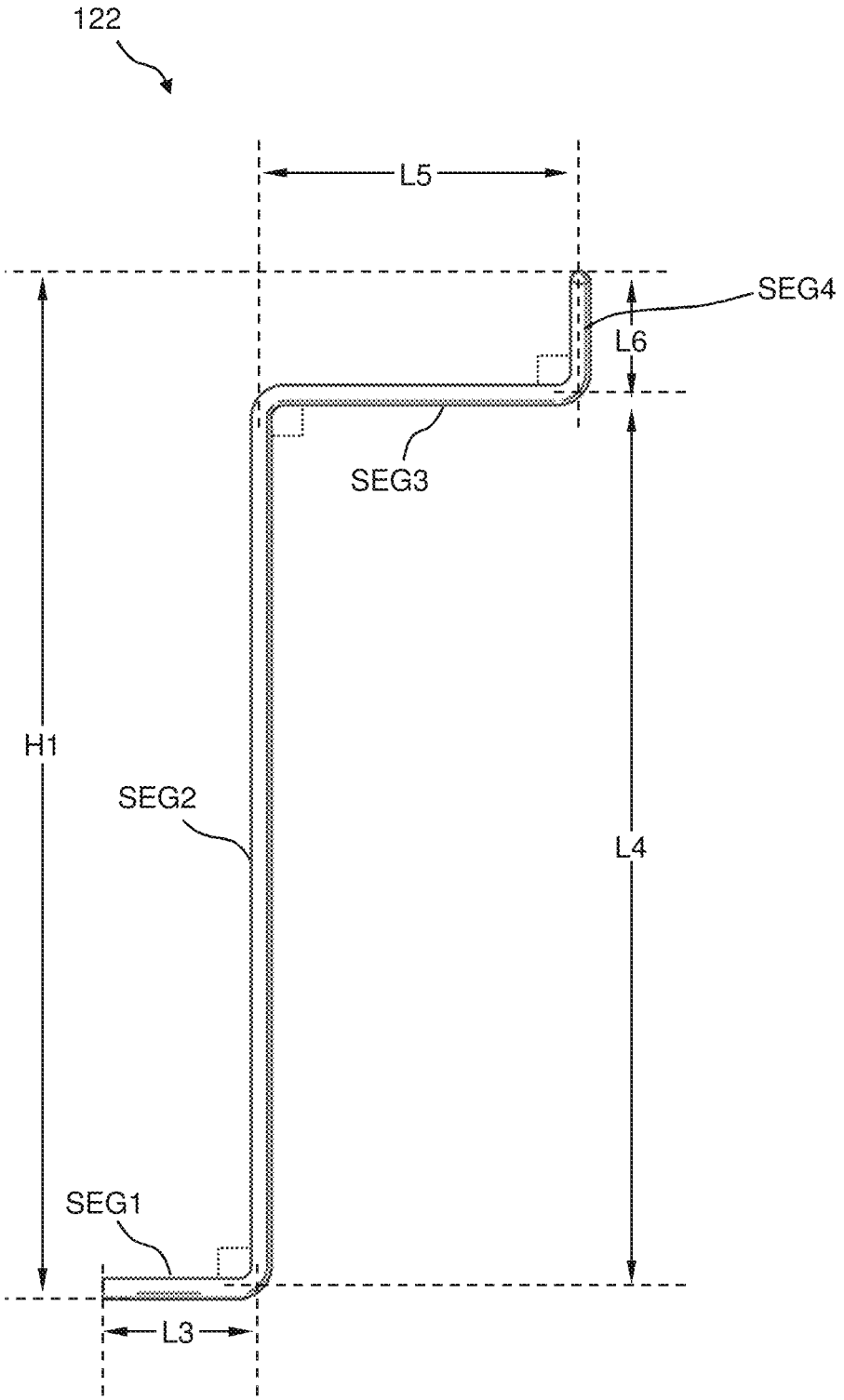
FIG. 10 illustrates a side view of the hanger bar portion of the rack of the presently disclosed bag rack.

More details of hanger bars 122 are now described with reference to FIG. 10, which illustrates a side view of one hanger bar 122 of hanger assembly 120 of bag rack 100. For example, each hanger bar 122 may be a rod that may include multiple segments, for example, four segments. Namely, each hanger bar 122 may be formed, in order, of segments SEG1, SEG2, SEG3, and SEG4. For example, segment SEG1 may be designed to be mounted across and upon crossbars 114*b* and 114*c* of base assembly 110 of bag rack 100. Segment SEG1 has a length L3. Next, segment SEG2 continues substantially orthogonal from one end of segment SEG1, as shown. Segment SEG2 has a length L4. Next, segment SEG3 continues substantially orthogonal from the other end of segment SEG2, as shown. Segment SEG3 may be substantially parallel to segment SEG1. Segment SEG3 has a length L5. Next, segment SEG4 continues substantially orthogonal from the other end of segment SEG3, as shown. Segment SEG4 may be substantially parallel to segment SEG2. Segment SEG4 has a length L6. Additionally, each hanger bar 122 has an overall height H1. While the above example is illustrated as having four segments, it is contemplated that each hanger bar 122 may have more or less segments, and the above is just an example of one embodiment.

In bag rack 100, segments SEG1 of hanger bars 122*a* and 122*b* of hanger assembly 120 may be affixed to crossbars 114*b* and 114*c* of base assembly 110. For example, hanger assembly 120 may be affixed to base assembly 110 via welding, adhesive (e.g., epoxy adhesive), or other suitable means.

Further and referring now to FIG. 1 through FIG. 10, side bars 112 and crossbars 114 of base assembly 110 of bag rack 100, as well as hanger bars 122 and hanger crossbars 124 of hanger assembly 120 of bag rack 100 may have a cross-sectional diameter D1. The cross-sectional diameter D1 of all of these components may be the same or may be different. Further, the cross-sectional diameter D1 may vary depending on the type of material of which side bars 112 and crossbars 114 of base assembly 110 and hanger bars 122 and hanger crossbars 124 of hanger assembly 120 are formed.

Referring now to FIG. 11 is a side view of the optional hooking device 130 of bag rack 100. Hooking device 130 may be a bar with hooks on one or both ends. Hooking device 130 may be formed, for example, of metal, plastic, or other suitable material. For example, hooking device 130 may include a bar 132 that may have a hook 134 at one end and a hook 136 at the opposite end, as shown. Bar 132 has a cross-sectional diameter D2. In one example, the diameter D2 may be about ¼ inches. Hook 134 of hooking device 130 may be designed to engage crossbar 114*a* of base assembly 110 of bag rack 100, while hook 136 may be designed to hook onto the edge of resealable opening 194 of storage bags 190, as shown in FIG. 1. Hook 134 may be formed by bending bar 132 back on itself. In one example, hook 134 may be open enough to engage with crossbar 114*a* when in use, and then disengage from crossbar 114*a* when not in use. In another example, hook 134 may wrap around crossbar 114*a* in a manner that hooking device 130 is permanently coupled to crossbar 114*a* in a sliding (side-to-side) and pivoting fashion. The inside bend radius of hook 134 may be slightly greater than cross-sectional diameter D1 of crossbar 114*a*. Hook 136 may be formed by bending bar 132 back on itself. Hook 136 may be set at an angle sufficient for easily engaging with the edge of resealable opening 194 of a storage bag 190.

Table 1 below shows example specifications of bag rack 100. Note the dimensions listed in Table 1 below are non-limiting examples only, and other dimensions are contemplated and within the scope of the invention.

| Specification | Example |
|---|---|
| Spacing S1 of side bars 112a and 112b | in the range of about 13 inches |
| Spacing S2 of crossbars 114a and 114c | in the range of about 10¾ inches |
| Spacing S3 of crossbars 114b and 114c | in the range of about 1¼ inches |
| Spacing S4 of hanger bars 122a and 122b | in the range of from about 2.5 inches to about 3 inches |
| Spacing S5 of hanger crossbars 124a and 124c | in the range of about 1 inch |
| Length L1 of side bars 112 | in the range of about 12½ inches |
| Length L2 of crossbars 114 | in the range of about 13¼ inches |
| Length L3 of segment SEG1 of hanger bar 122 | in the range of about 2 inches |
| Length L4 of segment SEG2 of hanger bar 122 | in the range of about 9 inches |
| Length L5 of segment SEG3 of hanger bar 122 | in the range of about 3¼ inches |
| Length L6 of segment SEG4 of hanger bar 122 | in the range of about 1 inch |
| Overall Height H1 of hanger bar 122 | in the range of about 10 inches |
| Cross-sectional diameter D1 | in the range of about ¼ inches |

Figure 12:
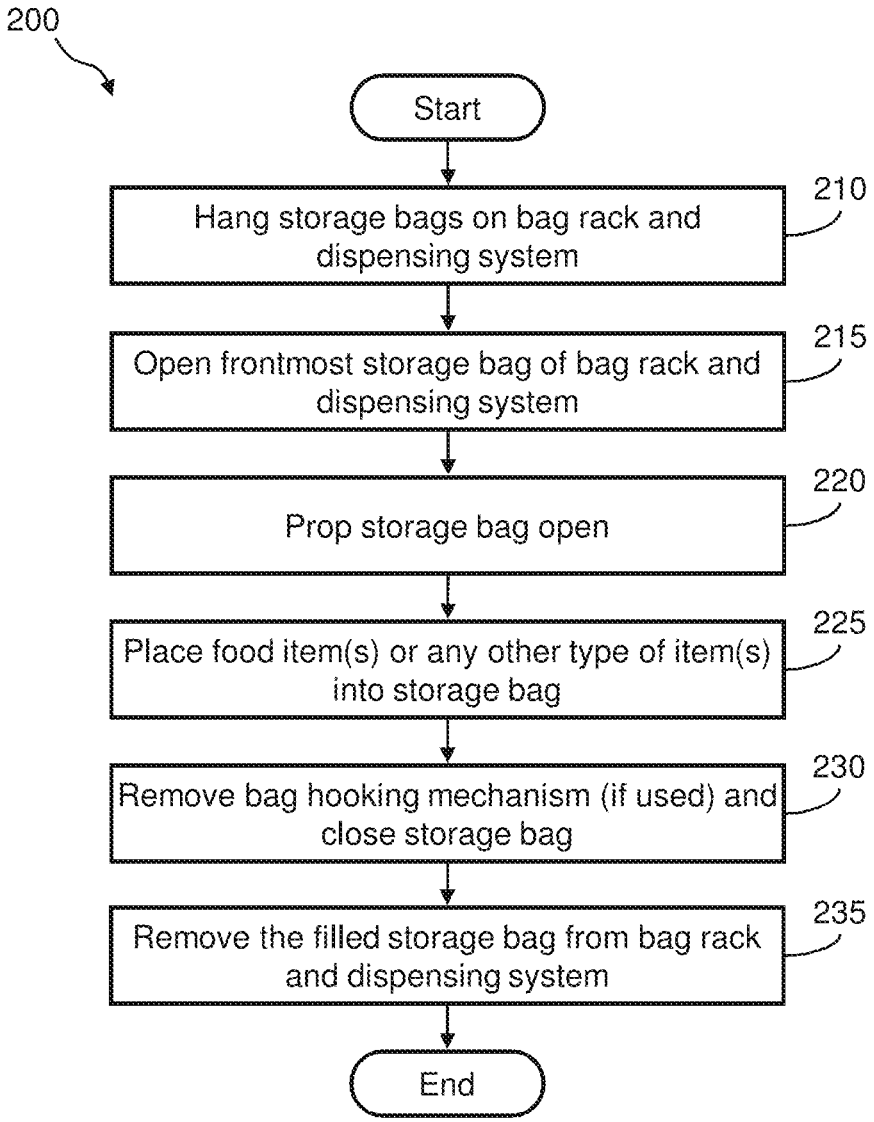
FIG. 12 illustrates a flow diagram of an example of a method of using the presently disclosed bag rack.

Referring now to FIG. 12 is a flow diagram of an example of a method 200 of using the presently disclosed bag rack 100 for packaging and dispensing food items. Method 200 may include, but is not limited to, the following steps.

At a step 210, one or more storage bags 190 are hung on bag rack 100. For example, one or more storage bags 190 are hung on bag rack 100 by sliding the carry handle cutouts 196 onto hanger assembly 120 of bag rack 100.

At a step 215, the frontmost storage bag 190 on bag rack 100 is opened. For example, the user opens resealable opening 194 of the frontmost storage bag 190.

Figure 13:
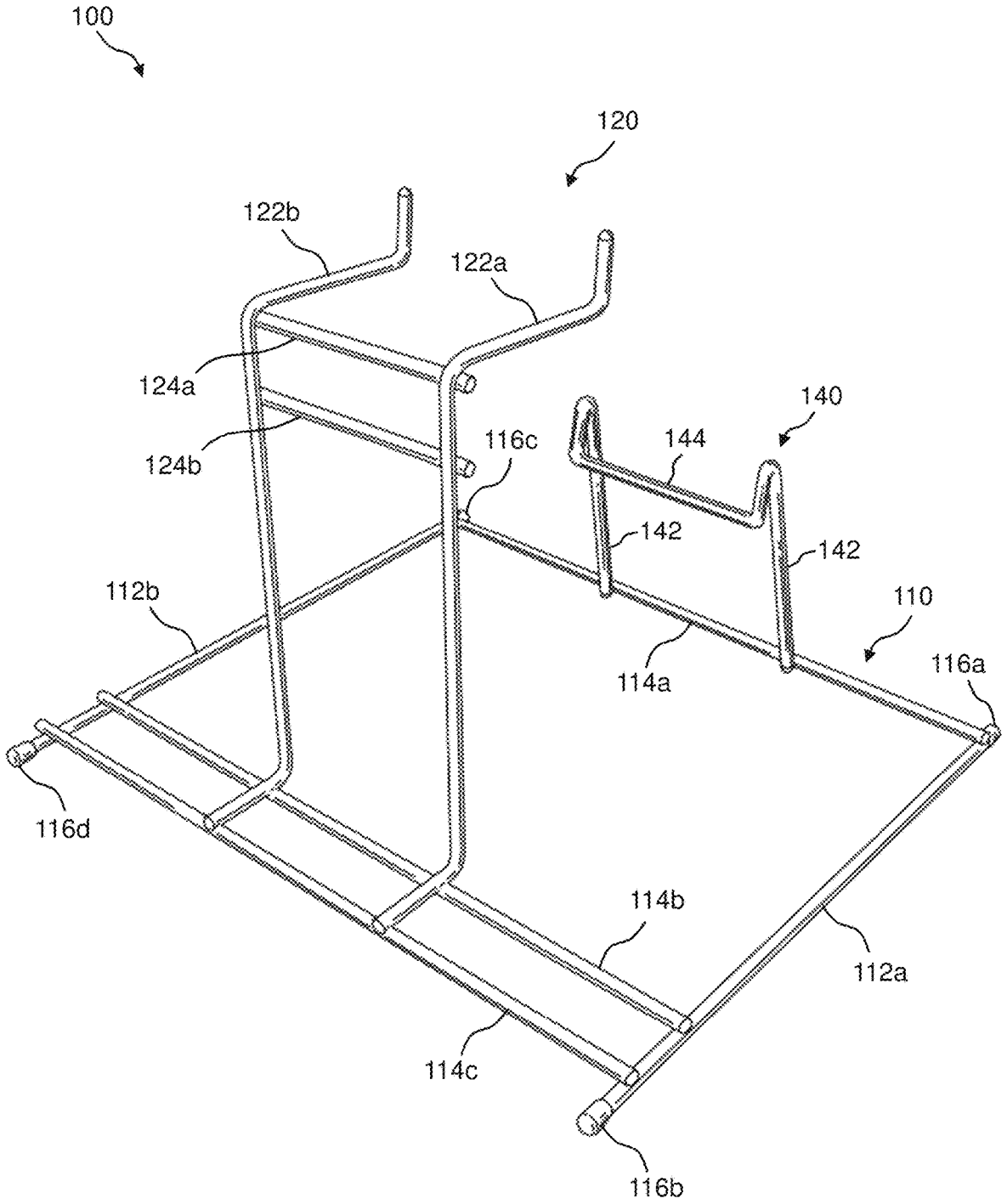
FIG. 13 and FIG. 14 illustrate a perspective view and a side view, respectively, of another example of the presently disclosed bag rack.
Figure 14:
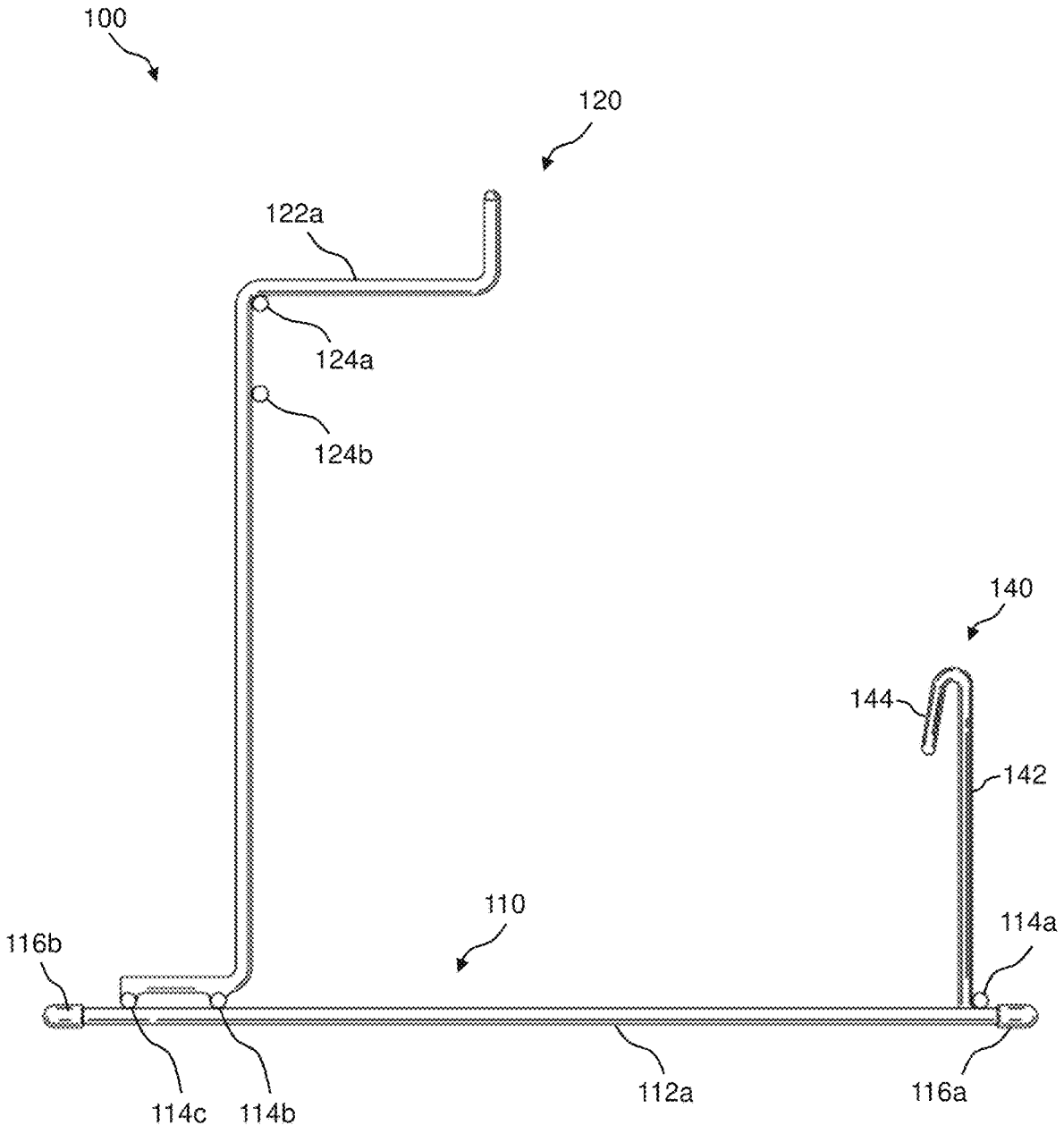
Figure 15:
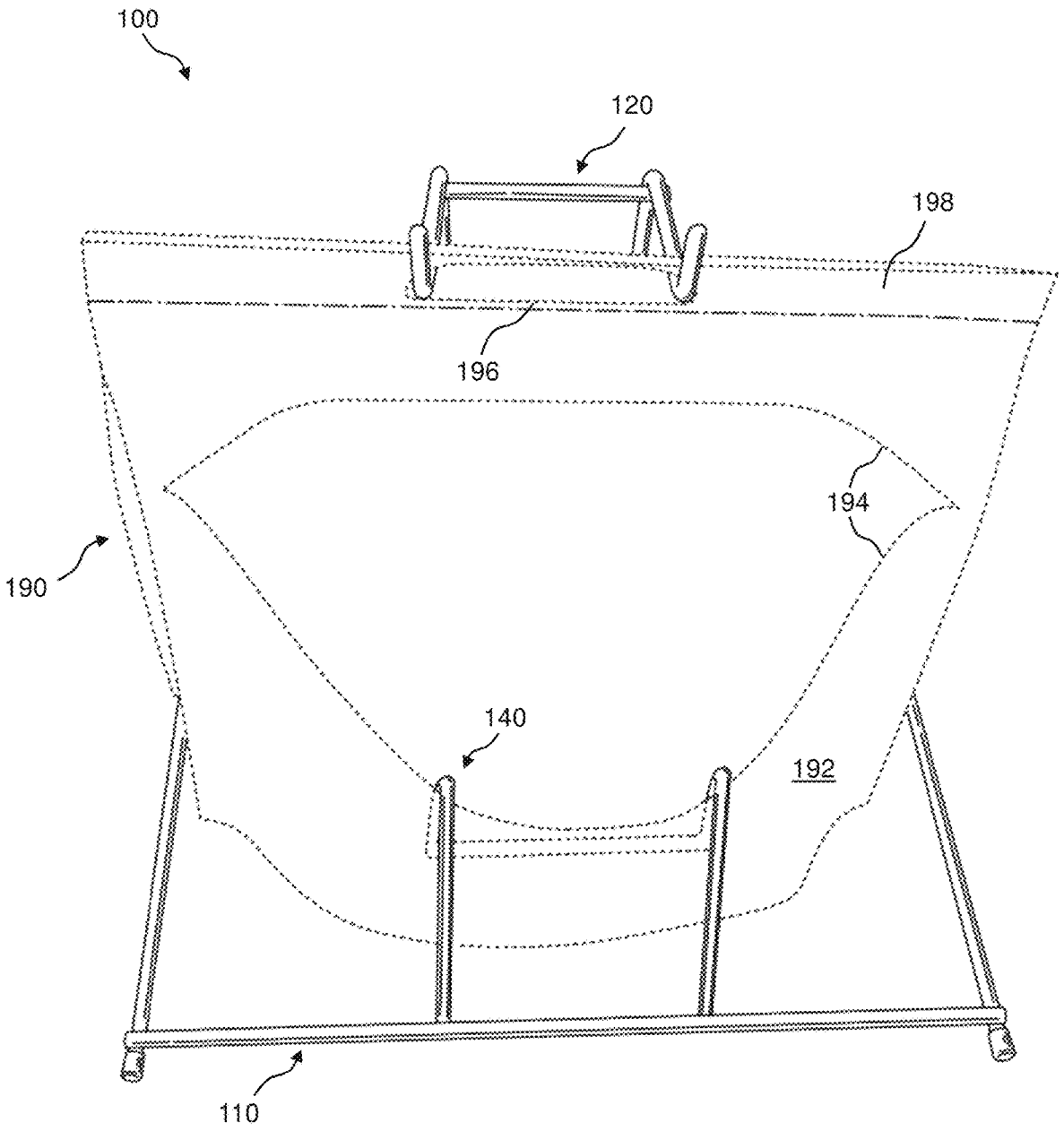
FIG. 15 illustrates a front perspective view of the bag rack shown in FIG. 13 and FIG. 14 holding one or more storage bags.

At a step 220, the storage bag 190 is held open by hand or propped open using any bag hooking mechanism, such as, but not limited to, hooking device 130 and a hooking bracket (see FIG. 13, FIG. 14, and FIG. 15). For example, hook 134 of hooking device 130 is engaged with crossbar 114*a*. Then, the edge of resealable opening 194 is pulled forward and hook 136 of hooking device 130 is engaged with the front edge of resealable opening 194, as shown in FIG. 1.

At a step 225, food item(s) or any other types of item(s) are placed into storage bag 190. The placement of the item(s) into storage bag 190 is made easy because by pulling the edge of resealable opening 194 forward the design of bag rack 100, in particular the front edge of resealable opening 194 is pulled forward, allowing for a wide opening and easy access to storage pouch 192 of storage bags 190, thus making loading storage bag 190 easier and more efficient then current methods. Loading storage bag 190 may also be facilitated by holding the resealable opening 194 wide open via the optional hooking device 130 and/or the hooking bracket (see FIG. 13, FIG. 14, and FIG. 15).

At a step 230, if a bag hooking mechanism is used, hooking device 130 and/or the hooking bracket (see FIG. 13, FIG. 14, and FIG. 15) may be removed from engagement with resealable opening 194 of storage bag 190. Then, resealable opening 194 of storage bag 190 is closed, thereby securing the contents of storage bag 190.

At a step 235, the filled storage bag 190 is removed from bag rack 100. For example, carry handle cutout 196 of the filled storage bag 190 is slipped off of and away from hanger assembly 120 of bag rack 100.

Referring now to FIG. 13 and FIG. 14 is a perspective view and a side view, respectively, of another example of the presently disclosed bag rack 100. In this example, bag rack 100 may further include a hooking bracket 140, wherein hooking bracket 140 may be fixed to crossbar 114*a* of base assembly 110 of bag rack 100. As shown, hooking bracket 140 may be, for example, an upside-down U-shaped structure. For example, hooking bracket 140 may include two sidebars 142 coupled by a hooking crossbar 144. The open ends of the two sidebars 142 may be affixed (e.g., welded, adhered) to crossbar 114*a*. Hooking crossbar 144 is used to engage with and hold the front edge of the open resealable opening 194 of storage bag 190, as shown, for example, in FIG. 15.

Figure 16:
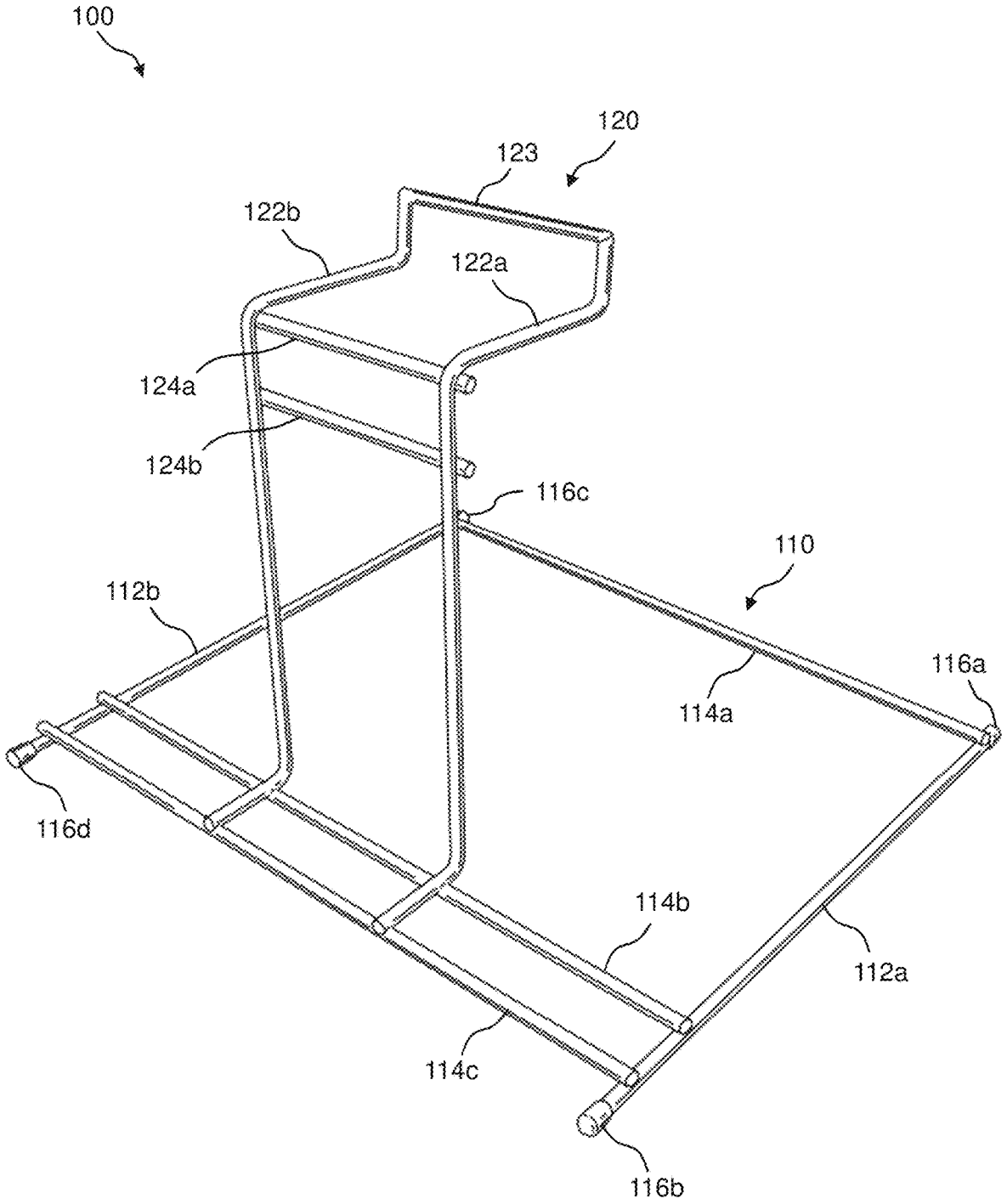
FIG. 16 and FIG. 17 illustrate a perspective view and a side view, respectively, of yet another example of the presently disclosed bag rack.
Figure 17:
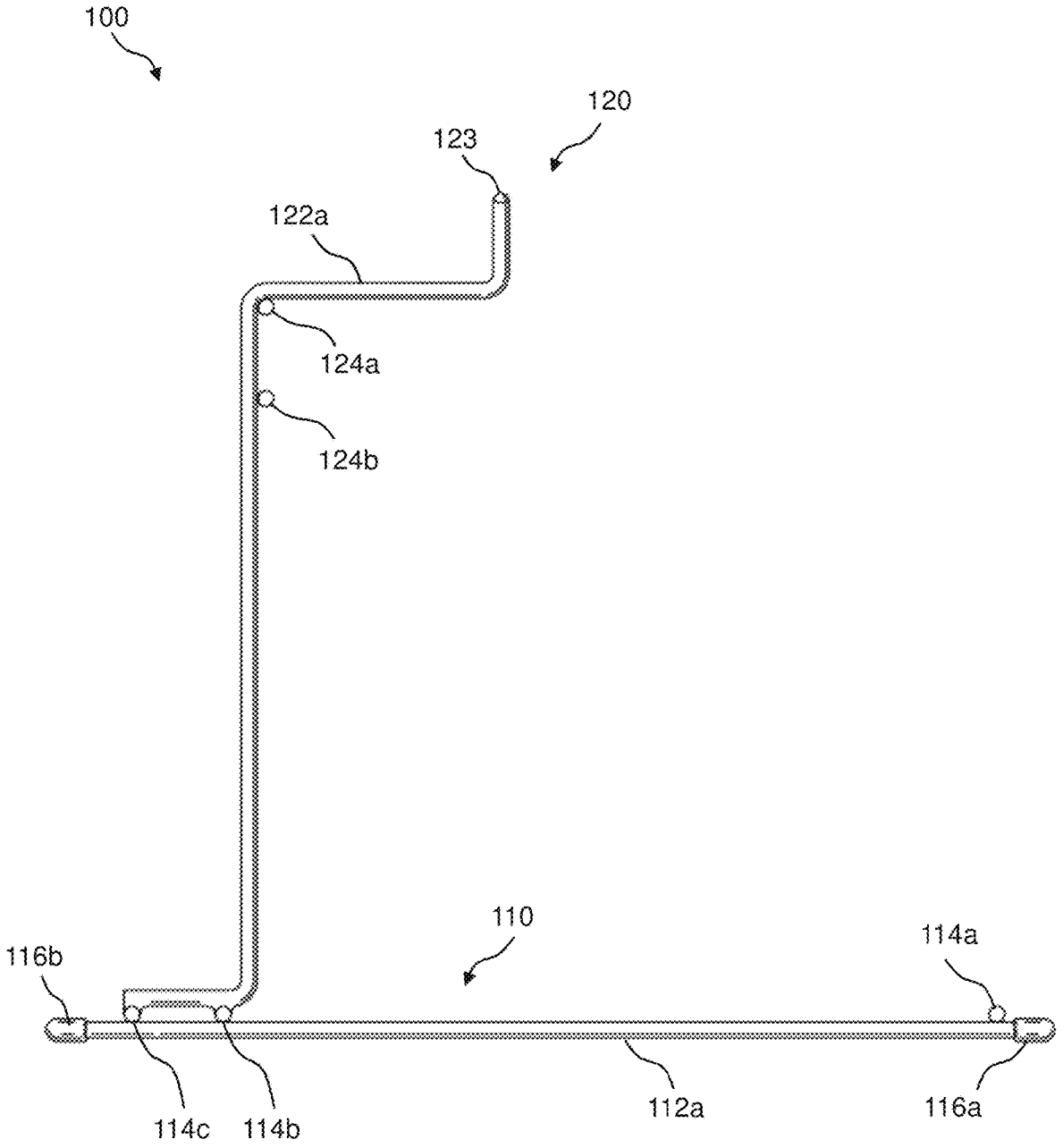
Figure 18:
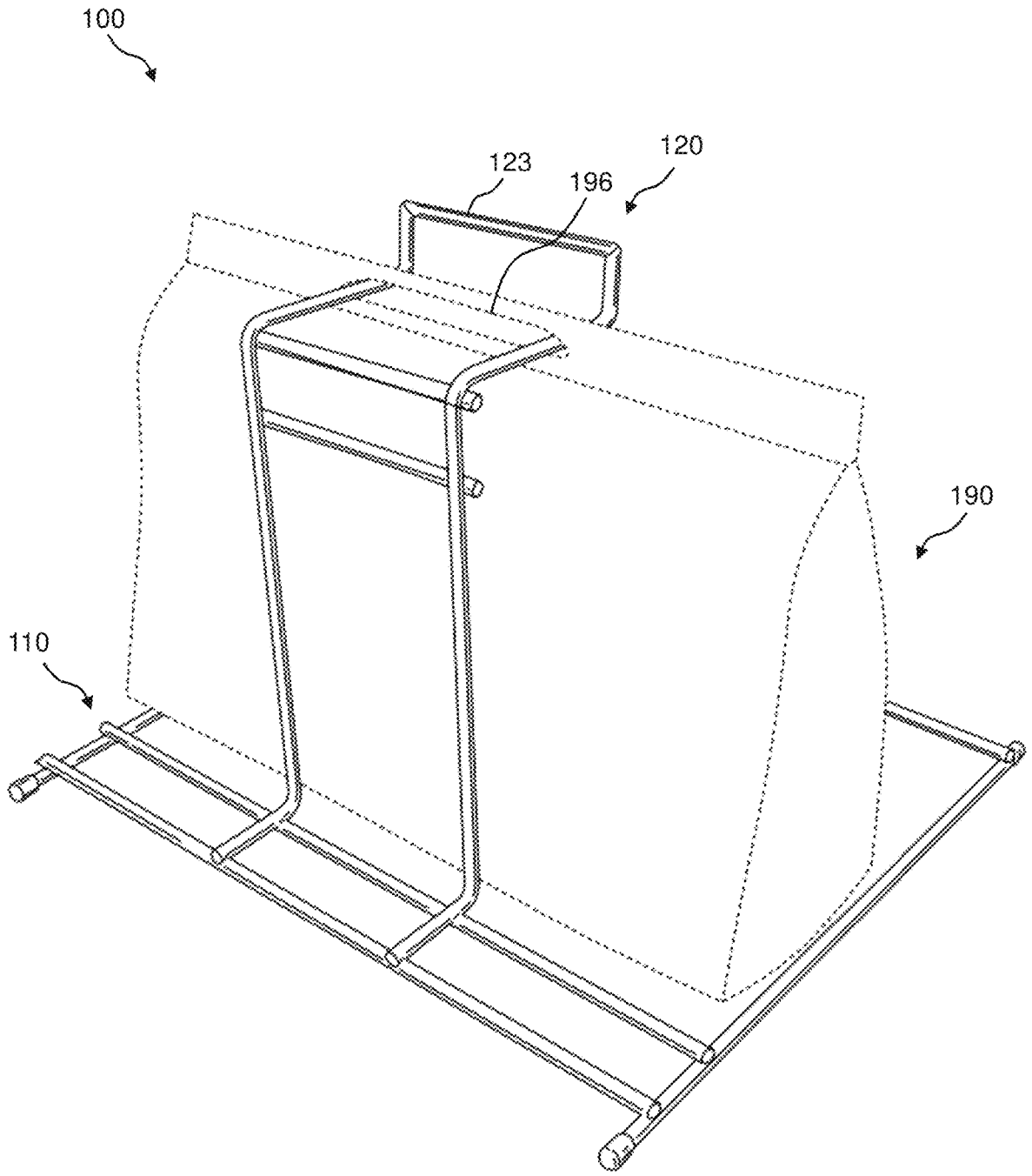
FIG. 18 illustrates a rear perspective view of the bag rack shown in FIG. 16 and FIG. 17 holding one or more storage bags.

Referring now to FIG. 16 and FIG. 17 is a perspective view and a side view, respectively, of yet another example of the presently disclosed bag rack 100. In this example, the two hanger bars 122 (i.e., 122*a*, 122*b*) of hanger assembly 120 are coupled at the top via a crossbar 123 to form a one-piece hanger structure. FIG. 18 shows a rear perspective view of bag rack 100 shown in FIG. 16 and FIG. 17 that includes crossbar 123 that is holding one or more storage bags 190.

Figure 19:
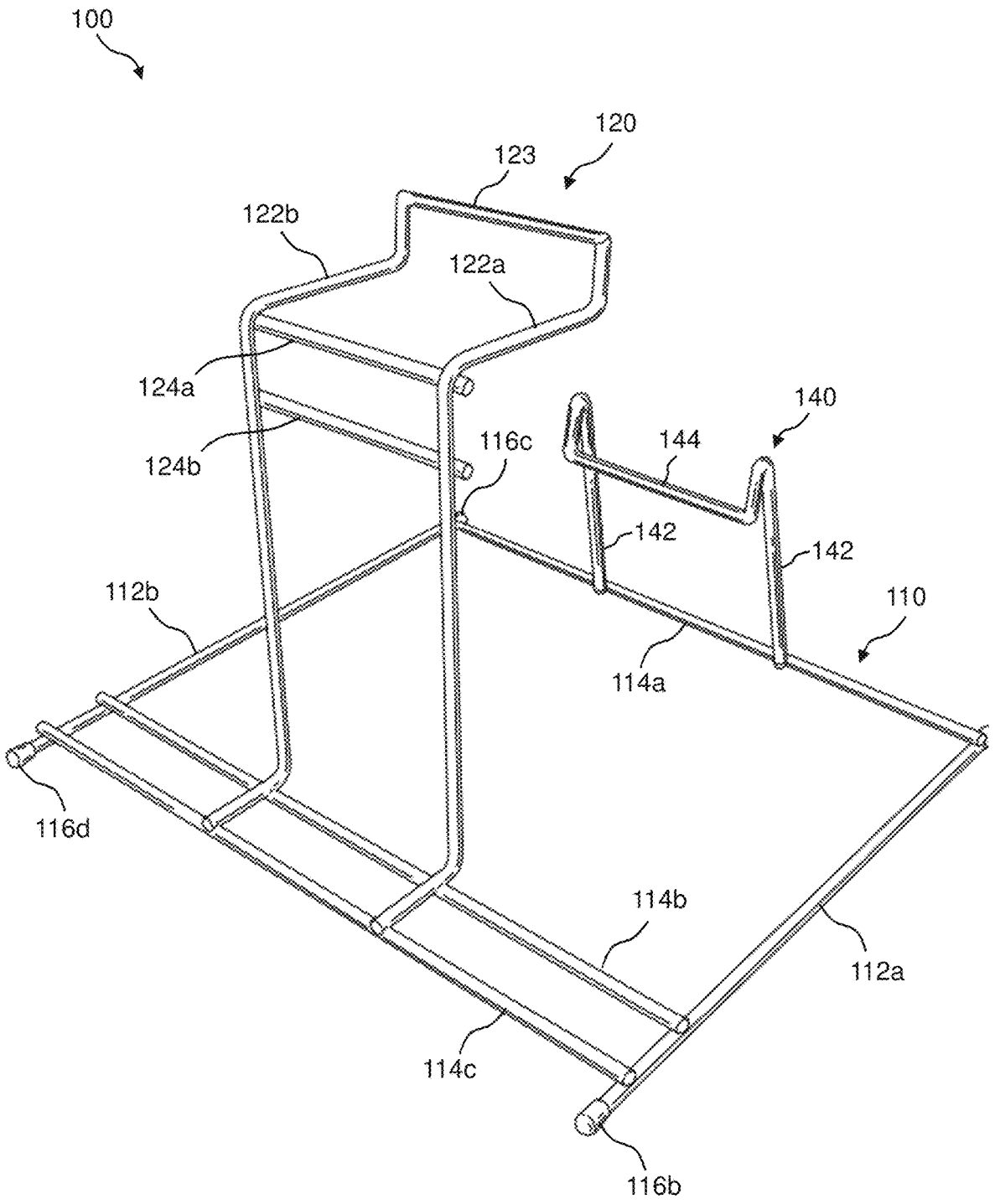
FIG. 19 and FIG. 20 illustrate a perspective view and a side view, respectively, of yet another example of the presently disclosed bag rack.
Figure 20:
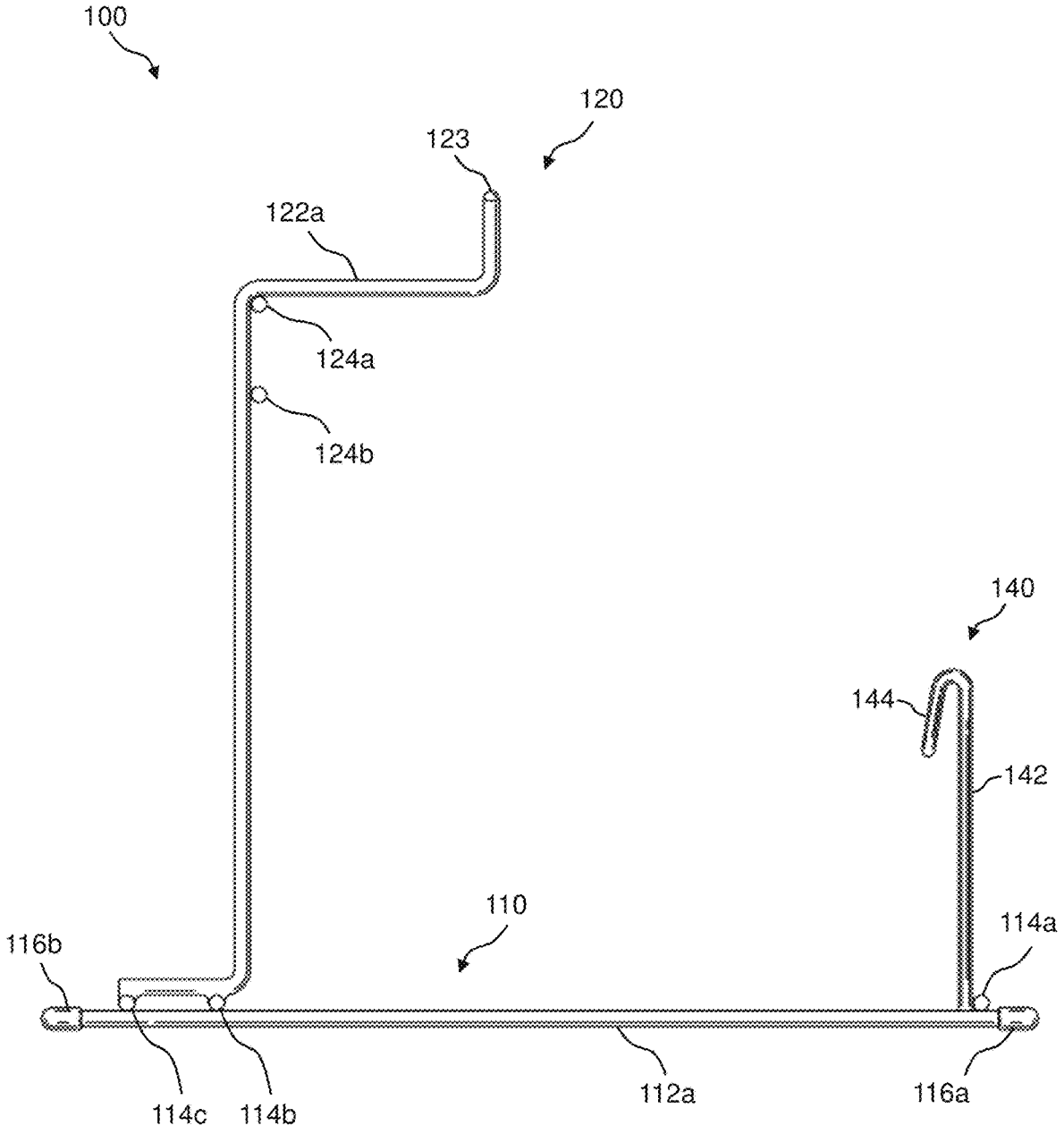
Figure 21:
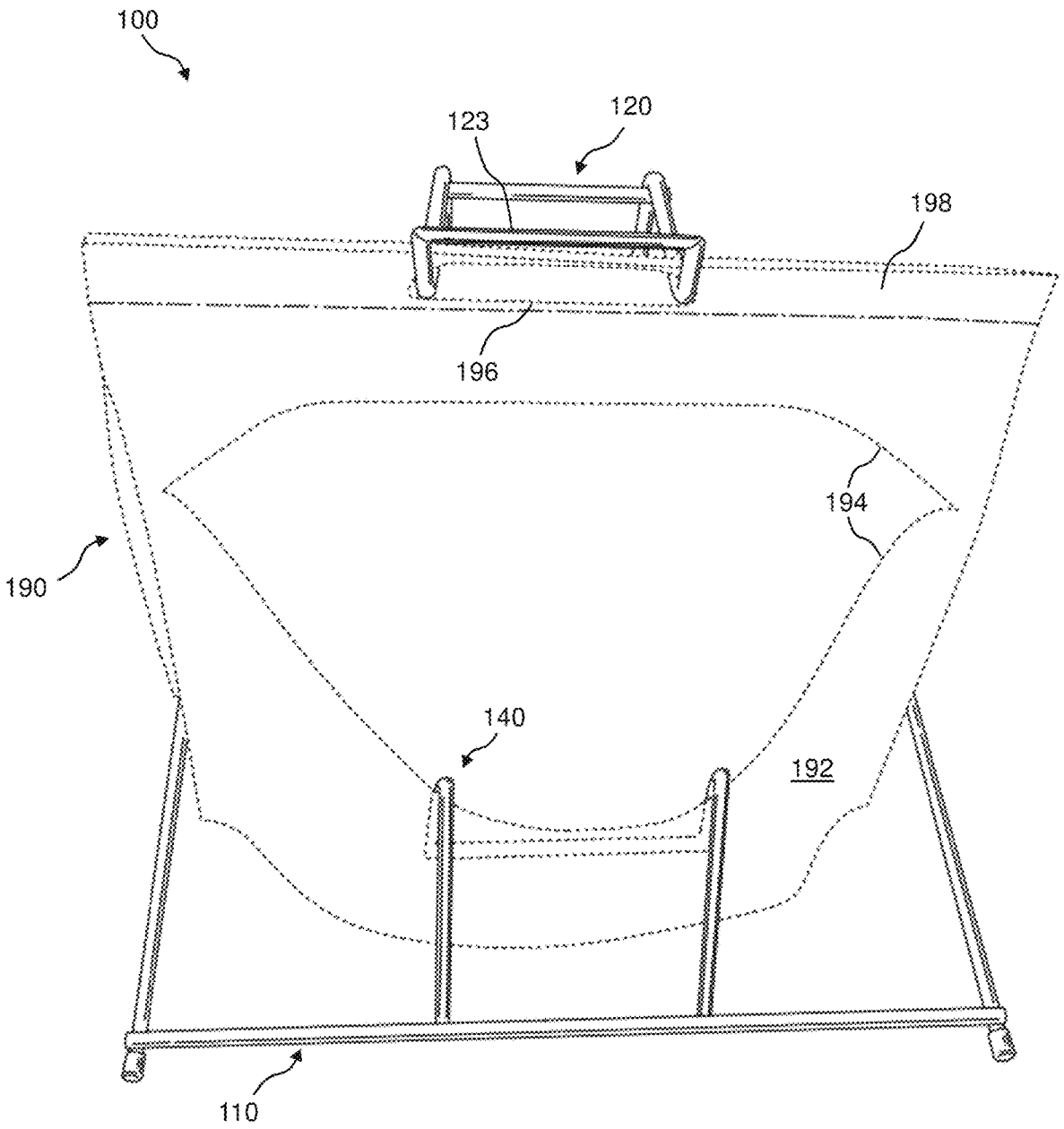
FIG. 21 illustrates a front perspective view of the bag rack shown in FIG. 19 and FIG. 20 holding one or more storage bags.

Referring now to FIG. 19 and FIG. 20 is a perspective view and a side view, respectively, of yet another example of the presently disclosed bag rack 100. In this example, hanger assembly 120 may include the one-piece hanger structure (i.e., hanger bars 122*a*, 122*b* and crossbar 123) as shown in FIG. 16, FIG. 17, and FIG. 18. Additionally, in this example, bag rack 100 may include hooking bracket 140. Hooking bracket 140 is used to engage with and hold the front edge of the open resealable opening 194 of storage bag 190, as shown, for example, in FIG. 21.

Figure 22:
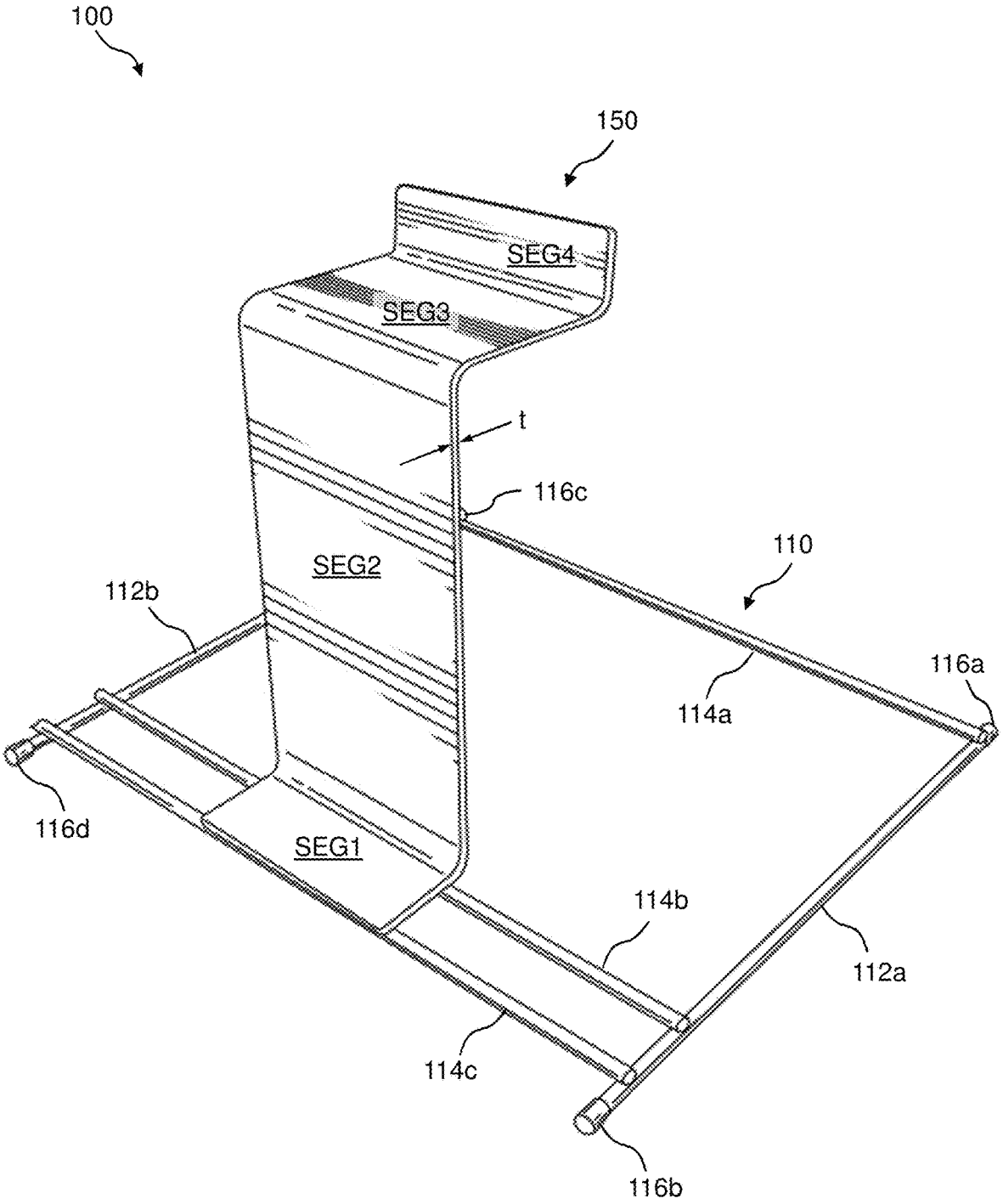
FIG. 22 and FIG. 23 illustrate a perspective view and a side view, respectively, of yet another example of the presently disclosed bag rack.
Figure 23:
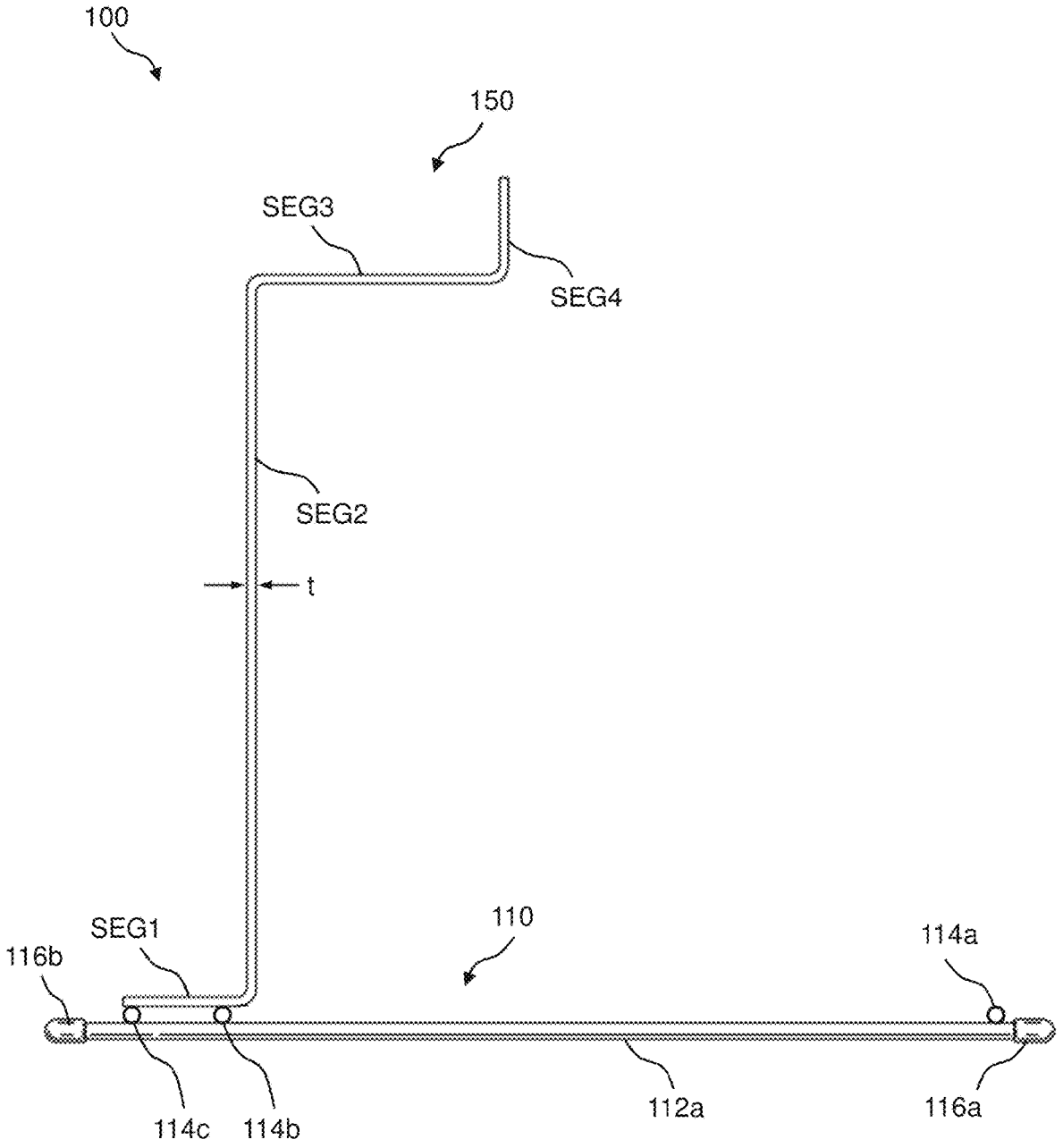
Figure 24:
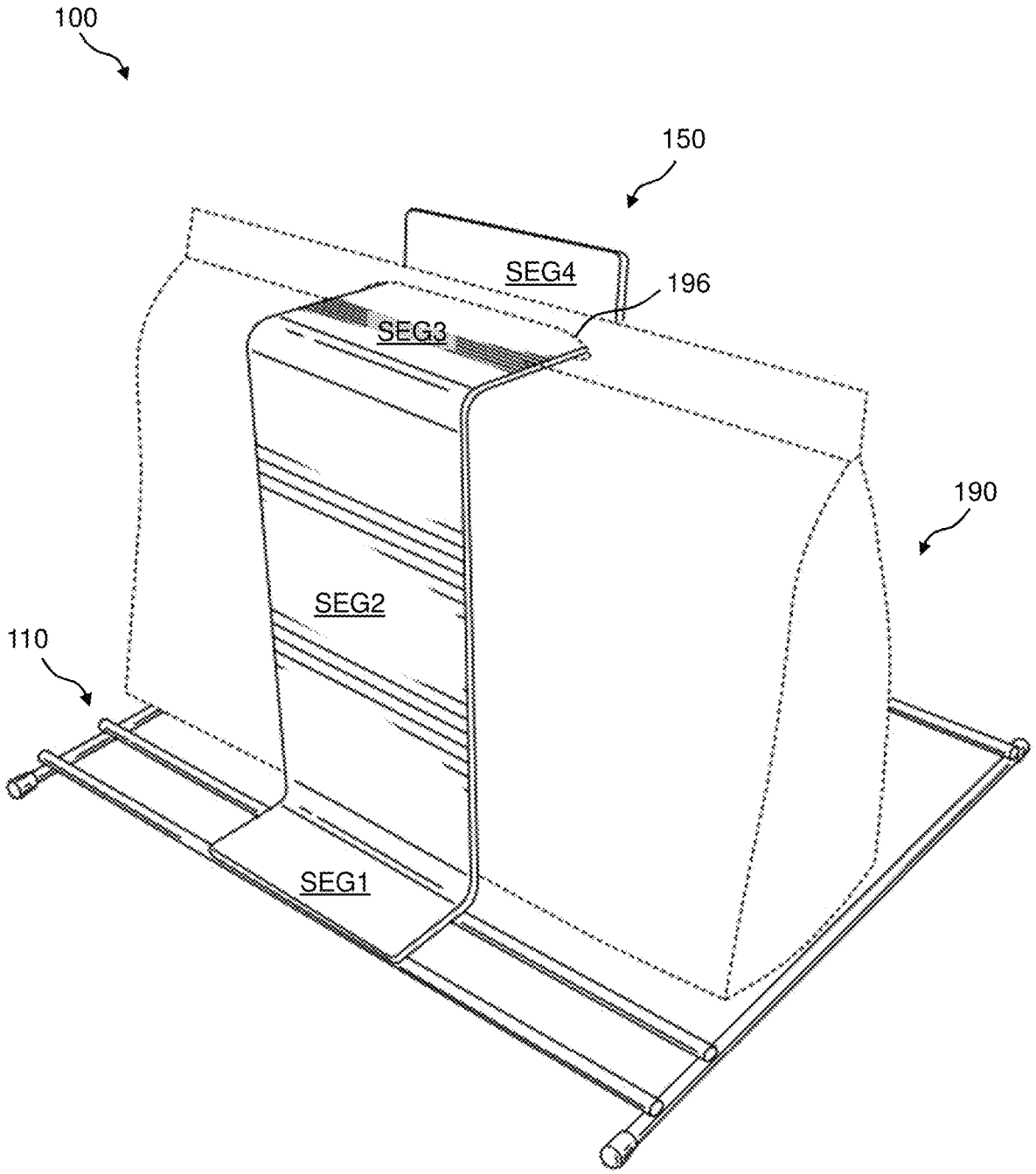
FIG. 24 and FIG. 25 illustrate a rear perspective view and a front perspective view, respectively, of the bag rack shown in FIG. 22 and FIG. 23 holding one or more storage bags.
Figure 25:
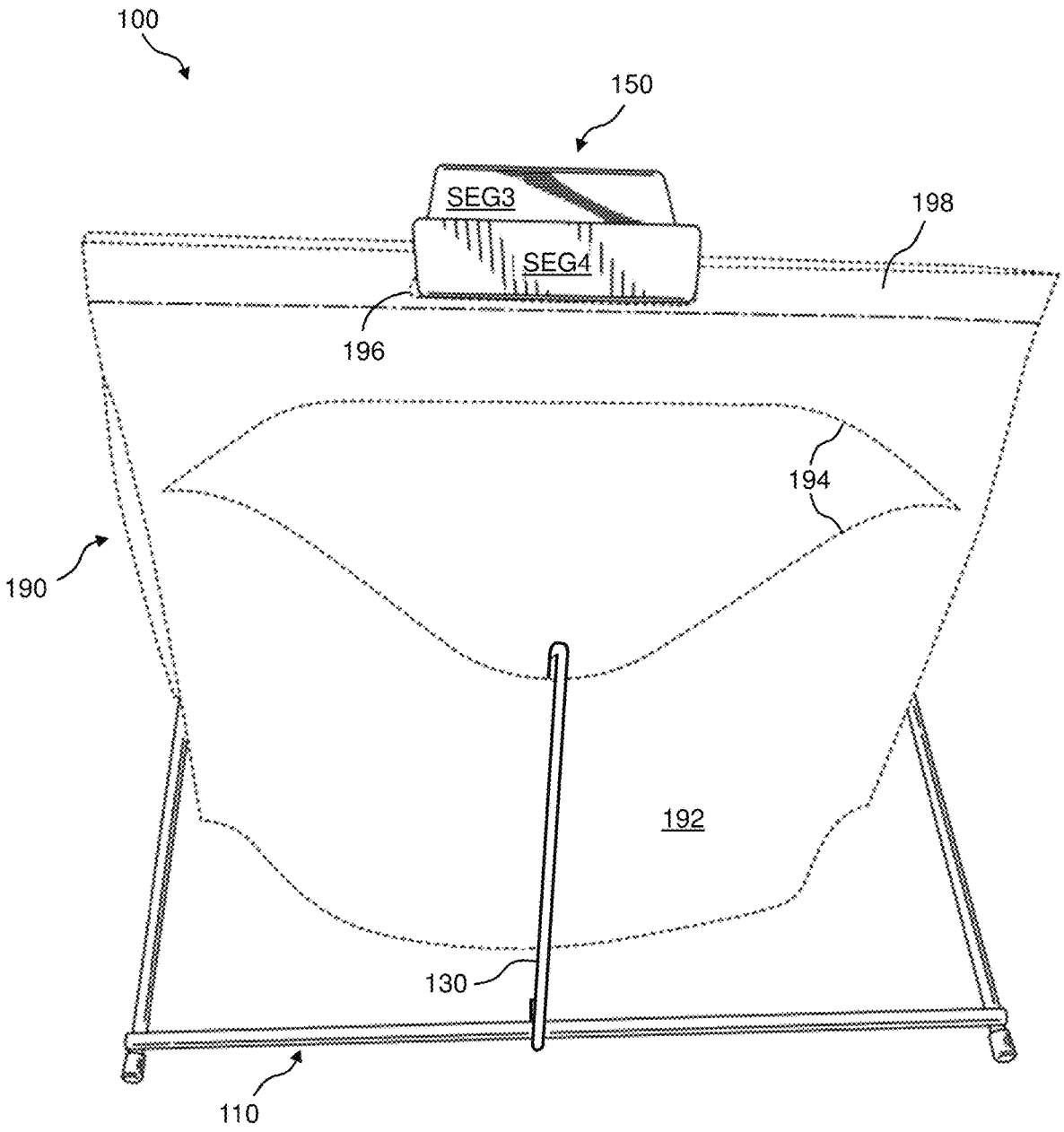

Referring now to FIG. 22 and FIG. 23 is a perspective view and a side view, respectively, of yet another example of the presently disclosed bag rack 100. In this example, bag rack 100 may include a hanger plate 150 in place of hanger assembly 120 mounted atop crossbars 114*b* and 114*c*. That is, in this example, bag rack 100 may include base assembly 110 and hanger plate 150. Hanger plate 150 may include multiple segments that substantially mimic the side profile of hanger bars 122, as shown, for example, in FIG. 10. For example, like hanger bars 122, hanger plate 150 may include segment SEG1, segment SEG2, segment SEG3, and segment SEG4. Segment SEG1 of hanger plate 150 may be coupled to crossbars 114*b* and 114*c* via, for example, welding and/or adhesive. FIG. 24 and FIG. 25 show the bag rack 100 shown in FIG. 22 and FIG. 23 wherein one or more storage bags 190 are hung on hanger plate 150. Further, FIG. 25 shows hanger plate 150 used in combination with hooking device 130 to hold open the resealable opening 194 of storage bag 190.

Figure 26:
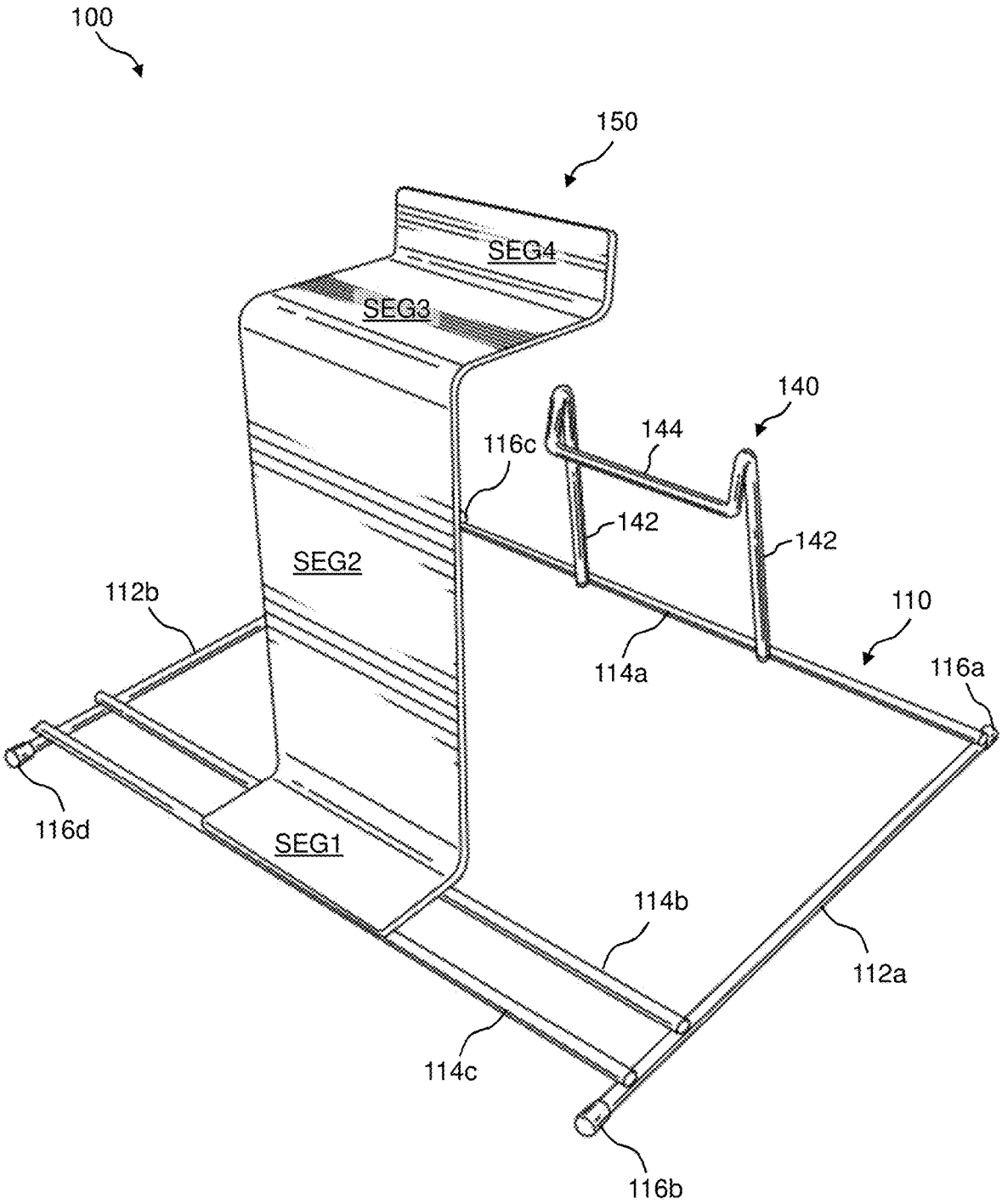
FIG. 26 and FIG. 27 illustrate a perspective view and a side view, respectively, of still another example of the presently disclosed bag rack.
Figure 27:
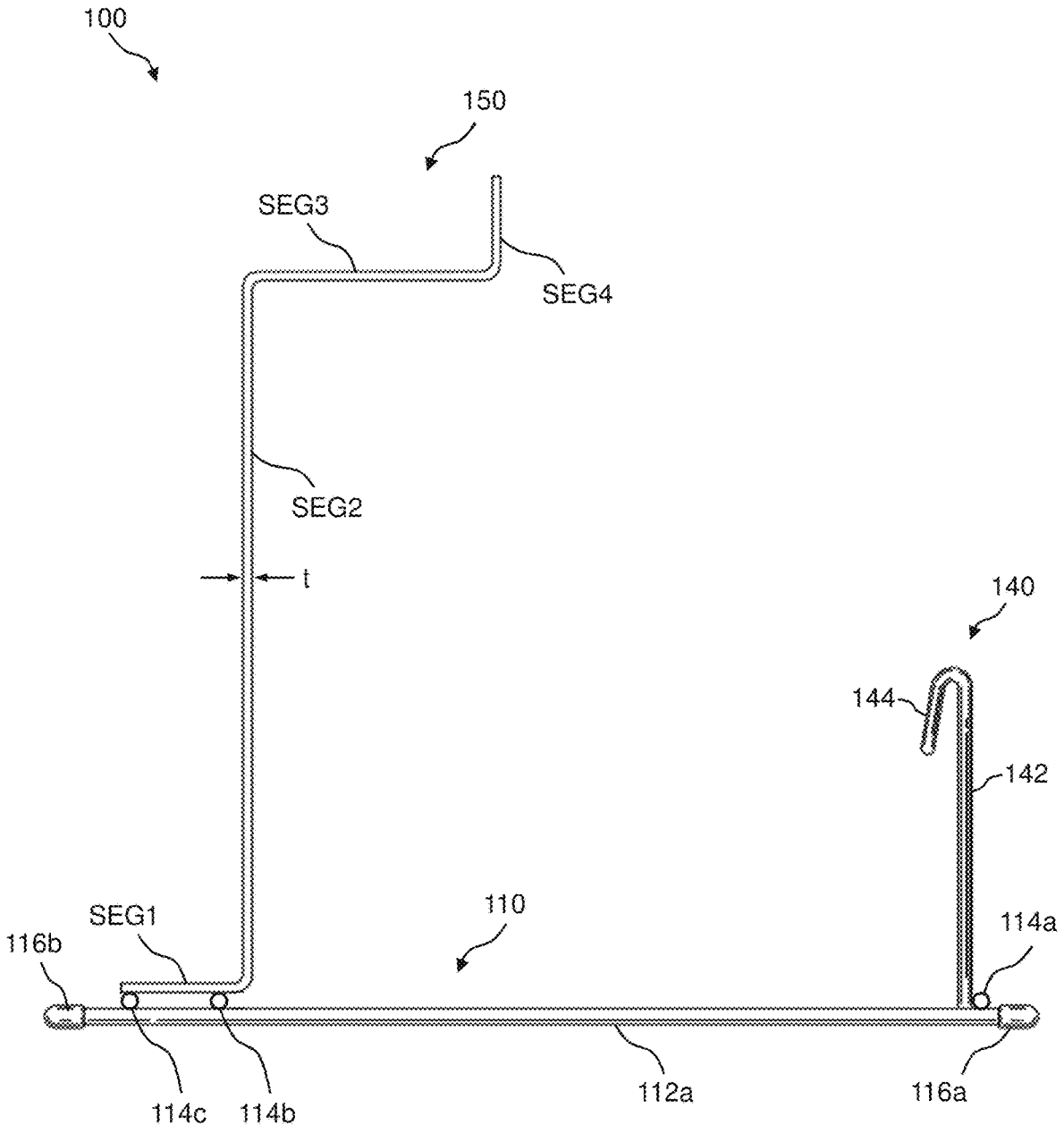
Figure 28:
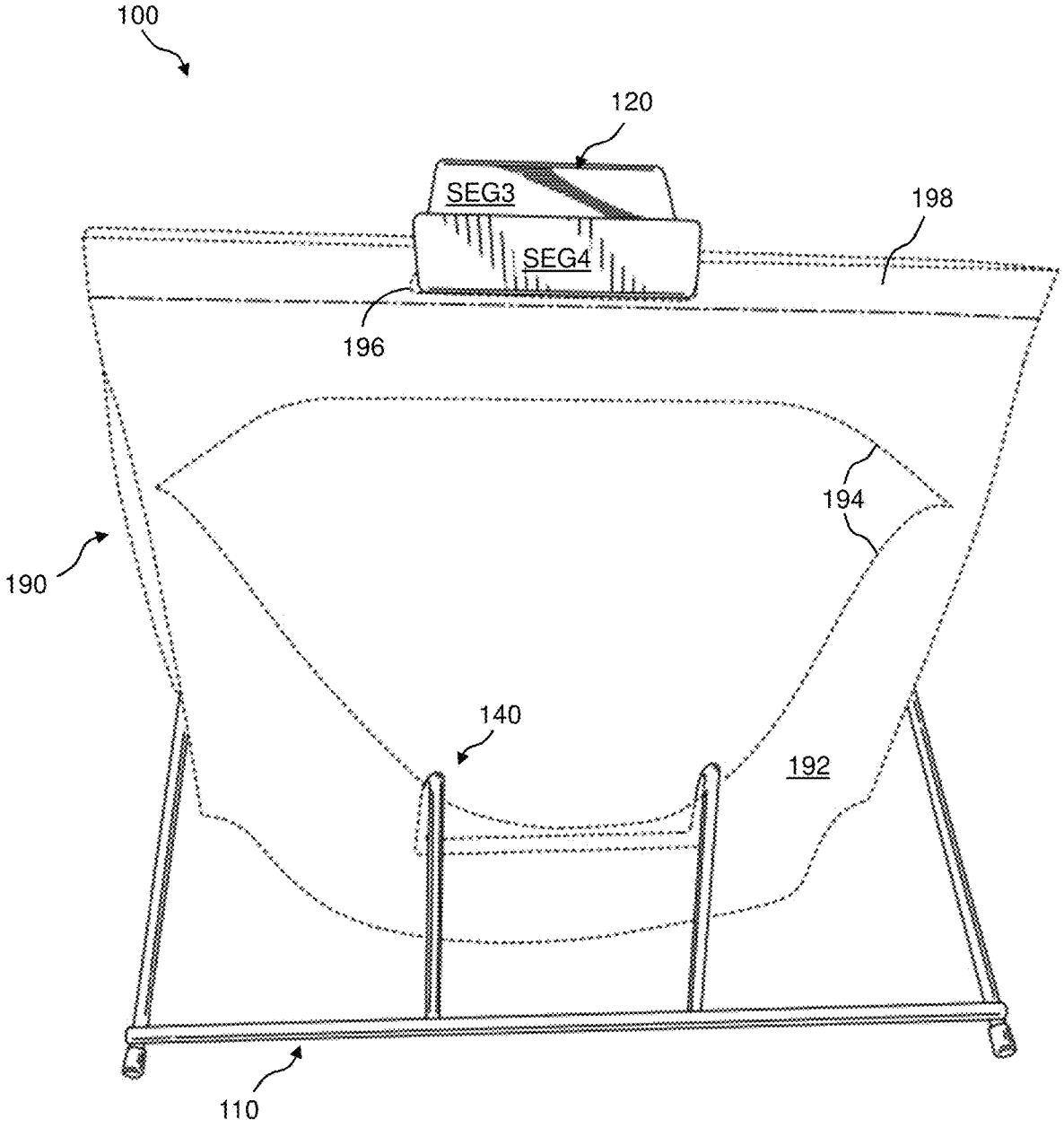
FIG. 28 illustrates a front perspective view of the bag rack shown in FIG. 26 and FIG. 27 holding one or more storage bags.

Referring now to FIG. 26 and FIG. 27 is a perspective view and a side view, respectively, of still another example of the presently disclosed bag rack 100. In this example, bag rack 100 may include base assembly 110, hanger plate 150, and hooking bracket 140. Again, hooking bracket 140 is used to hold open the resealable opening 194 of storage bag 190, as shown, for example, in FIG. 28.

Referring again to FIG. 1 through FIG. 28, an example application for using bag rack 100 and method 200 is a grocery store deli or any food deli. For example, in the grocery store deli, multiple rotisserie chickens are being cooked and prepared for sale. In this example, multiple bag racks 100 may be set up with the frontmost storage bag 190 propped open in a similar manner as described in step 220 of method 200. Once the multiple rotisserie chickens are finished cooking, one at a time, the cooked rotisserie chickens can be dropped or placed into the storage bags 190 of successive bag racks 100. The storage bags 190 are then closed and removed from bag rack 100 and the rotisserie chickens (in the storage bags 190) are placed on display for sale. During the next cooking cycle, the multiple bag racks 100 can be readied for filling another set of storage bags 190. Further, bag rack 100 and method 200 allow the storage bags 190 to be easily packed by one person, whereas conventional methods may require one person to hold open the storage bag while a second person places the food items in the bag.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

The invention claimed is:

1. A bag rack and dispensing system, comprising:

a base assembly comprising side bars and crossbars coupled to the side bars, wherein at least one of the crossbars is located at a front portion of the base assembly;

a hanger assembly, configured to support a plurality of storage bags in a removable manner thereon, mounted to the base assembly and comprising:

a first segment coupled to one or more of the crossbars and positioned horizontally;

a second segment extending from the first segment at a first bend in a vertical direction, wherein the first bend is in a perpendicular direction relative to the first segment;

a third segment extending from the second segment at a second bend in a horizontal direction distally away from the first segment, wherein the second bend is in a perpendicular direction relative to the second segment; and a fourth segment extending from the third segment at a third bend in a vertical direction distally away from the second segment, wherein the third bend is in a perpendicular direction relative to the third segment; and a hooking assembly, configured to assist in holding open at least one of the plurality of storage bags, wherein the hooking assembly is mounted to a crossbar at the front portion of the base assembly, wherein the hooking assembly comprises two opposing hooking bars parallel to and spaced horizontally apart from one another, the two opposing hooking bars extending vertically upward from the crossbar at their first ends, and each including a hook end formed at a second end thereof, the hook end extending in a downward direction towards the base assembly, and wherein the hooking assembly further comprises a hooking crossbar extending between the second ends of the two opposing hooking bars.

2. The system of claim 1, wherein the two opposing hooking bars are continuous hooking bars.

3. The system of claim 1, wherein the side bars and the crossbars are arranged to forma box-shaped structure.

4. The system of claim 1, wherein the side bars are arranged parallel to one another and the crossbars are arranged parallel to one another and wherein the side bars are arranged perpendicular to the crossbars.

5. The system of claim 1, wherein the base assembly comprises two side bars and three crossbars, wherein the three crossbars span a distance spaced between the two side bars.

6. The system of claim 1, wherein the hanger assembly is mounted and affixed to one or more of the crossbars.

7. The system of claim 1, wherein the hanger assembly comprises hanger bars and one or more hanger crossbars.

8. The system of claim 7, wherein the hanger bars are arranged parallel to one another.

9. The system of claim 7, wherein at least two hanger crossbars extend between the hanger bars within the second segment, and one of the at least two hanger crossbars is in contact with the third segment.

10. The system of claim 7, wherein at least one hanger crossbar extends between the hanger bars at an endpoint of the hanger bars within the fourth segment.

11. The system of claim 1, wherein the hanger assembly comprises a continuous hanger plate.

12. The system of claim 1, further comprising the plurality of storage bags, each of the storage bags comprising a top portion and a detachable bottom portion, wherein the top portion comprises an engagement mechanism for engaging with the hanger assembly, and wherein the detachable bottom portion comprises a storage pouch and a resealable opening providing access to the storage pouch.

13. The system of claim 12, wherein the engagement mechanism for engaging with the hanger assembly comprises holes for engaging hanger bars of the hanger assembly.

14. The system of claim 12, wherein the bottom portion is detachable from the top portion by a perforation spanning a bottom edge of the top portion.

15. The system of claim 12, wherein each of the plurality of storage bags further comprises a handle.

16. The system of claim 12, wherein the plurality of storage bags are bound together at the top portion.

17. The system of claim 12, wherein the plurality of storage bags are configured to store food items.

* * * * *